US009695842B2

(12) United States Patent
Akiyama et al.

(10) Patent No.: US 9,695,842 B2
(45) Date of Patent: Jul. 4, 2017

(54) HYDRAULIC DRIVE SYSTEM

(71) Applicant: KOMATSU LTD., Tokyo (JP)

(72) Inventors: Teruo Akiyama, Kokubunji (JP); Noboru Iida, Chigasaki (JP); Koji Saito, Fujisawa (JP); Takayuki Watanabe, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 383 days.

(21) Appl. No.: 14/374,446

(22) PCT Filed: Jun. 27, 2013

(86) PCT No.: PCT/JP2013/067615
§ 371 (c)(1),
(2) Date: Jul. 24, 2014

(87) PCT Pub. No.: WO2014/013852
PCT Pub. Date: Jan. 23, 2014

(65) Prior Publication Data

US 2015/0013320 A1 Jan. 15, 2015

(30) Foreign Application Priority Data

Jul. 17, 2012 (JP) ..... 2012-158429

(51) Int. Cl.
*F15B 13/02* (2006.01)
*F15B 11/08* (2006.01)
(Continued)

(52) U.S. Cl.
CPC ..... *F15B 13/021* (2013.01); *E02F 9/2095* (2013.01); *E02F 9/2203* (2013.01);
(Continued)

(58) Field of Classification Search
CPC . F15B 13/021; F15B 2211/785; E02F 9/2289; E02F 9/2292
See application file for complete search history.

(56) References Cited

U.S. PATENT DOCUMENTS 7,543,449 B2 * 6/2009 Ivantysynova ..... F15B 7/006 60/464
8,033,107 B2 * 10/2011 Tikkanen ..... F15B 7/006 60/464
(Continued)

FOREIGN PATENT DOCUMENTS

JP 57-144601 A 9/1982
JP 59-43703 A 3/1984
(Continued)

OTHER PUBLICATIONS

The International Search Report for the corresponding international application No. PCT/JP2013/067615, issued on Aug. 13, 2013.

*Primary Examiner* — Eric Keasel
*Assistant Examiner* — Matthew Wiblin
(74) *Attorney, Agent, or Firm* — Global IP Counselors, LLP

(57) ABSTRACT

A hydraulic cylinder causes a work implement to be lowered due to the exhaust of hydraulic fluid from a first chamber and the supply of hydraulic fluid to a second chamber. A hydraulic fluid flowpath has a first flowpath and a second flowpath. The first flowpath connects a first pump port and the first chamber. The second flowpath connects a second pump port and the second chamber. The hydraulic fluid flowpath configures a closed circuit between a hydraulic pump and the hydraulic cylinder. A bleed-off flowpath branches off from the first flowpath. A portion of hydraulic fluid exhausted from the first chamber when lowering the work implement flows into the bleed-off flowpath.

12 Claims, 13 Drawing Sheets

(51) Int. Cl.
*E02F 9/22* (2006.01)
*F15B 21/14* (2006.01)
*E02F 9/20* (2006.01)

(52) U.S. Cl.
CPC ..... *E02F 9/2217* (2013.01); *E02F 9/2235* (2013.01); *E02F 9/2289* (2013.01); *E02F 9/2292* (2013.01); *E02F 9/2296* (2013.01); *F15B 11/08* (2013.01); *F15B 21/14* (2013.01); *F15B 2211/20561* (2013.01); *F15B 2211/20576* (2013.01); *F15B 2211/27* (2013.01); *F15B 2211/3122* (2013.01); *F15B 2211/3133* (2013.01); *F15B 2211/353* (2013.01); *F15B 2211/7053* (2013.01); *F15B 2211/785* (2013.01)

(56) References Cited

U.S. PATENT DOCUMENTS

| | | | | |
|---|---|---|---|---|
| 2012/0260641 | A1* | 10/2012 | Opdenbosch ..... | E02F 9/2217 60/327 |
| 2013/0098464 | A1* | 4/2013 | Knussman ..... | E02F 9/2235 137/12 |
| 2014/0130487 | A1* | 5/2014 | Akiyama ..... | E02F 9/2217 60/431 |
| 2014/0345265 | A1* | 11/2014 | Akiyama ..... | F15B 11/17 60/418 |

FOREIGN PATENT DOCUMENTS

| | | | |
|---|---|---|---|
| JP | 62-33947 | A | 2/1987 |
| JP | 2003-21104 | A | 1/2003 |

* cited by examiner

HYDRAULIC DRIVE SYSTEM

CROSS-REFERENCE TO RELATED APPLICATIONS

This application is a U.S. National stage application of International Application No. PCT/JP2013/067615, filed on Jun. 27, 2013. This U.S. National stage application claims priority under 35 U.S.C. §119(a) to Japanese Patent Application No. 2012-158429, filed in Japan on Jul. 17, 2012, the entire contents of which are hereby incorporated herein by reference.

BACKGROUND

Field of the Invention

The present invention relates to a hydraulic drive system.

Background Information

Work machines, such as a hydraulic excavator or a wheel loader, are equipped with a work implement driven by a hydraulic cylinder. Hydraulic fluid discharged from a hydraulic pump is supplied to the hydraulic cylinder. Hydraulic fluid is supplied via a hydraulic circuit to the hydraulic cylinder. For example, Japanese Patent Laid-open No. 2003-21104 describes a work machine equipped with a hydraulic closed circuit for supplying hydraulic fluid to the hydraulic cylinders. Potential energy of the work implement is regenerated due to the hydraulic circuit being a closed circuit. As a result, fuel consumption of a motor for driving the hydraulic pump can be reduced.

SUMMARY

For example, a hydraulic excavator has a boom and a boom cylinder. The boom is driven by the boom cylinder. The boom cylinder has a first chamber and a second chamber. The boom cylinder expands due to hydraulic fluid being supplied to the first chamber and hydraulic fluid being exhausted from the second chamber. Conversely, the boom cylinder contracts due to hydraulic fluid being exhausted from the first chamber and hydraulic fluid being supplied to the second chamber.

To improve work efficiency in the hydraulic excavator, the lowering speed of the boom needs to be set to a speed that is higher than the raising speed of the boom. For example, when comparing work times from a state in which a bucket is in contact with the ground until a state in which the boom cylinder is fully expanded, the time required for lowering the boom is preferably about 0.7 to 0.8 when the time required for raising the boom is 1. The raising speed of the boom is determined by the flow amount of the hydraulic fluid supplied to the first chamber. Therefore, the raising speed of the boom is determined in accordance with a discharge capacity of a hydraulic pump driven by a driving source. The lowering speed of the boom is determined by the flow amount of the hydraulic fluid exhausted from the first chamber. Therefore, the lowering speed of the boom is determined in accordance with a meter-out throttle of a control valve disposed between the hydraulic pump and the boom cylinder.

The hydraulic fluid is exhausted from the first chamber through the meter-out throttle and fed into a tank circuit when the boom is lowered in a so-called hydraulic open circuit instead of the abovementioned hydraulic closed circuit. Therefore, the lowering speed of the boom can be adjusted by adjusting the degree of the meter-out throttle. However, when adjusting the lowering speed of the boom as described above, the following problem arises when attempting to use a hydraulic closed circuit.

In the hydraulic closed circuit, the hydraulic fluid exhausted from the first chamber of the boom cylinder returns to the hydraulic pump when the boom is lowered. As a result, the hydraulic pump is driven. The hydraulic pump then regenerates potential energy of the work implement by enabling a motor action. Therefore, to increase the lowering speed of the boom, the flow amount of the hydraulic fluid that can be absorbed by the hydraulic pump needs to be increased. As a result, a large capacity hydraulic pump is required. This type of problem arises in the same way in a hydraulic closed circuit for driving a lift arm of a wheel loader or in a hydraulic closed circuit for driving a blade of a bulldozer.

An object of the present invention is to provide a hydraulic drive system that allows the lowering speed of a work implement to be increased without using a large-capacity hydraulic pump.

A hydraulic drive system according to a first aspect of the present invention includes a hydraulic pump, a driving source, a work implement, a hydraulic cylinder, a hydraulic fluid flowpath, and a bleed-off flowpath. The hydraulic pump has a first pump port and a second pump port. The hydraulic pump is switchable between a first state and a second state. The hydraulic pump inducts hydraulic fluid from the second pump port and discharges hydraulic fluid from the first pump port in the first state. The hydraulic pump inducts hydraulic fluid from the first pump port and discharges hydraulic fluid from the second pump port in the second state. The driving source drives the hydraulic pump. The hydraulic cylinder is driven by hydraulic fluid discharged from the hydraulic pump. The hydraulic cylinder has a first chamber and a second chamber. The hydraulic cylinder lowers the work implement due to the exhaust of hydraulic fluid from the first chamber and the supply of hydraulic fluid to the second chamber. The hydraulic cylinder raises the work implement due to the supply of hydraulic fluid to the first chamber and the exhaust of hydraulic fluid from the second chamber. The hydraulic fluid flowpath has a first flowpath and a second flowpath. The first flowpath connects the first pump port and the first chamber. The second flowpath connects the second pump port and the second chamber. The hydraulic fluid flowpath configures a closed circuit between the hydraulic pump and the hydraulic cylinder. The bleed-off flowpath branches off from the first flowpath. A portion of the hydraulic fluid exhausted from the first chamber when lowering the work implement flows into the bleed-off flowpath.

The hydraulic drive system according to a second aspect of the present invention is related to the hydraulic drive system of the first aspect, and further includes an operating member for operating the motions of the hydraulic cylinder. The full amount of the hydraulic fluid exhausted from the first chamber is returned to the first pump port through the first flowpath when an operation parameter in accordance with an operation amount of the operating member is less than a prescribed value when lowering the work implement. A portion of the hydraulic fluid exhausted from the first chamber flows into the bleed-off flowpath when the operation parameter is equal to or greater than the prescribed value when lowering the work implement. In this case, the flow amount of the hydraulic fluid returned to the first pump port is less than the full amount of the hydraulic fluid exhausted from the first chamber.

The hydraulic drive system according to a third aspect of the present invention is related to the hydraulic drive system of the second aspect, wherein the operation parameter is an operation amount of the operating member. The prescribed value is a prescribed operation amount that is smaller than a maximum operation amount of the operating member.

The hydraulic drive system according to a fourth aspect of the present invention is related to the hydraulic drive system of the third aspect, and further includes a control valve. The control valve controls the flow amount of the hydraulic fluid flowing into the bleed-off flowpath from the first flowpath. An opening of the control valve that connects the control valve to the bleed-off flowpath begins to open when the operation amount of the operating member reaches the prescribed operation amount, and the opening surface area is increased in accordance with an increase in the operation amount of the operating member.

The hydraulic drive system according to a fifth aspect of the present invention is related to the hydraulic drive system of the second aspect, wherein the hydraulic pump is a variable displacement pump. The operation parameter is a displacement of the hydraulic pump. The prescribed value is a maximum displacement of the hydraulic pump.

The hydraulic drive system according to a sixth aspect of the present invention is related to the hydraulic drive system of the fifth aspect, and further includes a control valve. The control valve controls the flow amount of the hydraulic fluid flowing into the bleed-off flowpath from the first flowpath. The opening that connects the control valve to the bleed-off flowpath begins to open when the displacement of the hydraulic pump reaches the maximum displacement, and the opening surface area is increased in accordance with an increase in the operation amount of the operating member.

The hydraulic drive system according to a seventh aspect of the present invention is related to the hydraulic drive system of the second aspect, wherein the hydraulic pump is a variable displacement pump. The operation parameter is the displacement of the hydraulic pump. The prescribed value is a prescribed displacement smaller than the maximum displacement of the hydraulic pump.

The hydraulic drive system according to an eighth aspect of the present invention is related to the hydraulic drive system of the seventh aspect, and further includes a control valve. The control valve controls the flow amount of the hydraulic fluid flowing into the bleed-off flowpath from the first flowpath. The opening that connects the control valve to the bleed-off flowpath begins to open when the displacement of the hydraulic pump reaches the prescribed displacement, and the opening surface area is increased in accordance with an increase in the operation amount of the operating member.

The hydraulic drive system according to a ninth aspect of the present invention is related to the hydraulic drive system of the first aspect, and further includes a control valve and a rotation speed sensor. The control valve controls the flow amount of the hydraulic fluid flowing into the bleed-off flowpath from the first flowpath. The rotation speed sensor detects a rotation speed of the hydraulic pump or of the driving source. When the rotation speed of the hydraulic pump or of the driving source exceeds a prescribed value that is less than a prescribed allowable rotation speed, the opening that connects the control valve to the bleed-off flowpath beings to open and the opening surface area is increased in accordance with an increase in the rotation speed.

The hydraulic drive system according to a tenth aspect of the present invention is related to the hydraulic drive system of any one of the first to ninth aspects, and further includes a charge circuit for replenishing hydraulic fluid to the hydraulic fluid flowpath. The bleed-off flowpath is connected to the charge circuit.

The hydraulic drive system according to an eleventh aspect of the present invention is related to the hydraulic drive system of any one of the first to ninth aspects, and further includes a hydraulic fluid tank for storing the hydraulic fluid. The bleed-off flowpath is connected to the hydraulic fluid tank.

The hydraulic drive system according to a twelfth aspect of the present invention is related to the hydraulic drive system of any one of the first to eleventh aspects, and further includes a return flowpath. The return flowpath branches off from the first flowpath. The return flowpath returns a portion of the hydraulic fluid exhausted from the first chamber to a second flowpath.

A portion of the hydraulic fluid exhausted from the first chamber when lowering the work implement flows into the bleed-off flowpath in the hydraulic drive system according to the first aspect of the present invention. As a result, the flow amount of the hydraulic fluid exhausted from the first chamber can be increased even without the use of a large-capacity hydraulic pump. As a result, the lowering speed of the work implement can be increased even without the use of a large-capacity hydraulic pump.

The intention of an operator to quickly lower the work implement is reflected in the operation parameter in the hydraulic drive system according to the second aspect of the present invention. Therefore, an operational feeling of the work implement can be improved due to the use of the operation parameter to control the flow of hydraulic fluid to the bleed-off flowpath.

A portion of the hydraulic fluid exhausted from the first chamber flows to the bleed-off flowpath when the operation amount of the operating member is equal to or greater than a prescribed operation amount that is smaller than the maximum operation amount of the operating member in the hydraulic drive system according to the third aspect of the present invention.

The lowering speed of the work implement can be increased even with an approximately fixed amount of suction fluid in the hydraulic pump in the hydraulic drive system according to the fourth aspect of the present invention.

A portion of the hydraulic fluid exhausted from the first chamber flows to the bleed-off flowpath when the displacement of the hydraulic pump reaches the maximum displacement of the hydraulic pump in the hydraulic drive system according to the fifth aspect of the present invention.

The lowering speed of the work implement can be increased even when the amount of suction fluid in the hydraulic pump reaches the maximum displacement in the hydraulic drive system according to the sixth aspect of the present invention.

A portion of the hydraulic fluid exhausted from the first chamber flows to the bleed-off flowpath when the displacement of the hydraulic pump reaches the prescribed displacement that is smaller than the maximum displacement of the hydraulic pump in the hydraulic drive system according to the seventh aspect of the present invention.

The lowering speed of the work implement can be increased even with an approximately fixed amount of suction fluid in the hydraulic pump in the hydraulic drive system according to the eighth aspect of the present invention.

The lowering speed of the work implement can be increased and the hydraulic pump or the driving source can be driven at a rotation speed that is lower than the allowable rotation speed in the hydraulic drive system according to the ninth aspect of the present invention.

A portion of the hydraulic fluid exhausted from the first chamber when lowering the work implement flows through the bleed-off flowpath to be fed into the charge circuit in the hydraulic drive system according to the tenth aspect of the present invention.

A portion of the hydraulic fluid exhausted from the first chamber when lowering the work implement flows through the bleed-off flowpath into the hydraulic fluid tank in the hydraulic drive system according to the eleventh aspect of the present invention.

A portion of the hydraulic fluid exhausted from the first chamber flows is fed into the bleed-off flowpath and another portion of the hydraulic fluid exhausted from the first chamber flows through the return flowpath and is returned to the second flowpath when lowering the work implement in the hydraulic drive system according to the twelfth aspect of the present invention. Accordingly, lowering speed of the work implement can be further increased.

DESCRIPTION OF EXEMPLARY EMBODIMENTS

A hydraulic drive system according to an exemplary embodiment of the present invention is explained hereinbelow with reference to the drawings.

First Exemplary Embodiment

Figure 1:
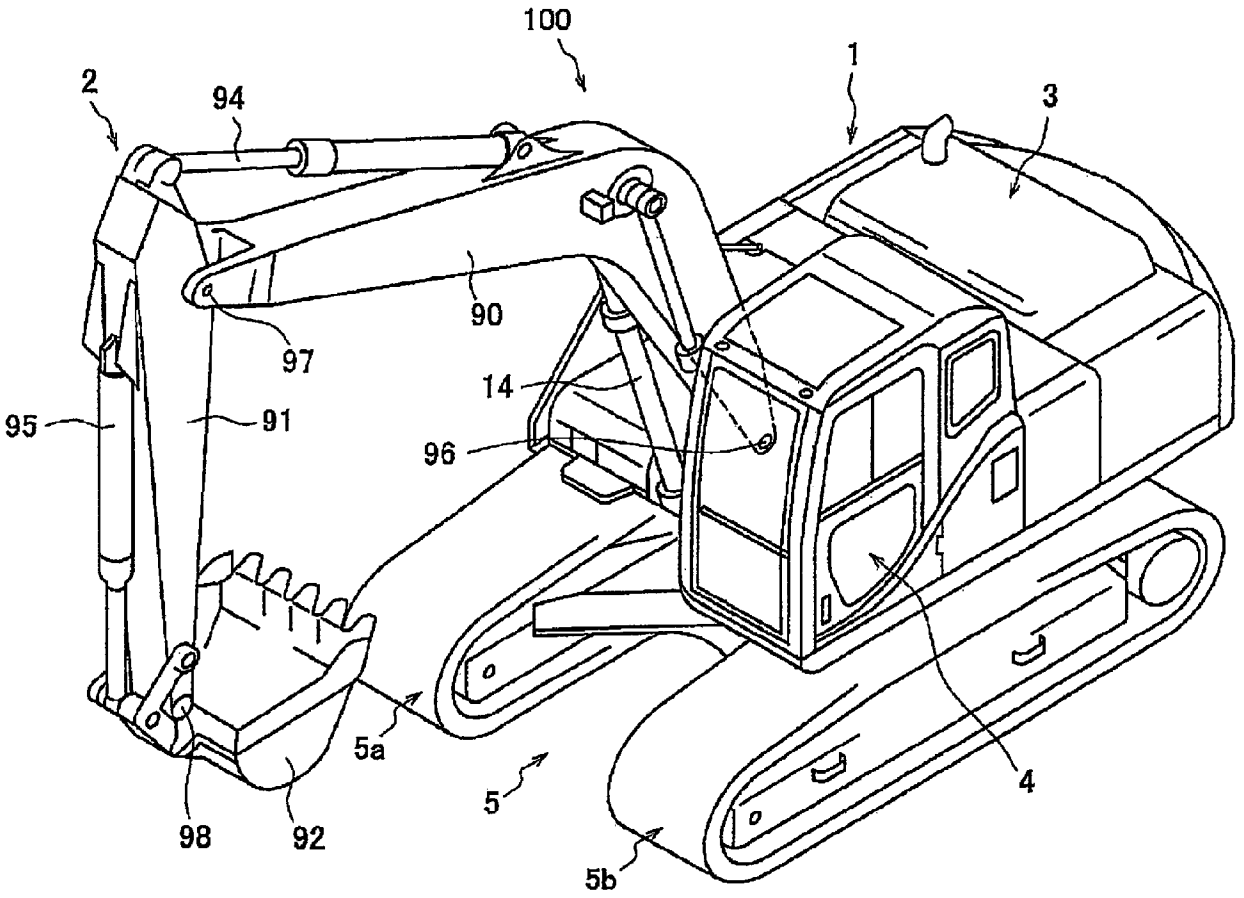
FIG. 1 is an external view of a hydraulic excavator on which the hydraulic drive system according to a first exemplary embodiment of the present invention is mounted.

FIG. 1 is a perspective view of a hydraulic excavator 100 on which the hydraulic drive system according to a first exemplary embodiment of the present invention is mounted. The hydraulic excavator 100 is equipped with a vehicle body 1 and a work implement 2. The vehicle body 1 has an upper revolving unit 3, a cab 4, and an undercarriage 5. The upper revolving unit is disposed on the undercarriage 5. The upper revolving unit 3 is provided in a rotatable manner with respect to the undercarriage 5. The upper revolving unit 3 contains devices such as an engine and a hydraulic pump described below. The cab 4 is disposed in the front section of the upper revolving unit 3. An operating device described below is provided inside the cab 4. The undercarriage 5 includes crawler tracks 5*a* and 5*b*, and the hydraulic excavator 100 travels due to the rotation of the crawler tracks 5*a* and 5*b*.

The work implement 2 is attached to the front section of the vehicle body 1 and includes a boom 90, an arm 91, and a bucket 92. The proximal end part of the boom 90 is attached in a swingable manner to the upper revolving unit 3 via a boom pin 96. The proximal end part of the arm 91 is attached in a swingable manner to the distal end part of the boom 90 via an arm pin 97. The bucket 92 is attached in a swingable manner to the distal end part of the arm 91 via a bucket pin 98. The boom 90 is driven by a hydraulic cylinder 14. The arm 91 is driven by a hydraulic cylinder 94. The bucket 92 is driven by a hydraulic cylinder 95.

Figure 2:
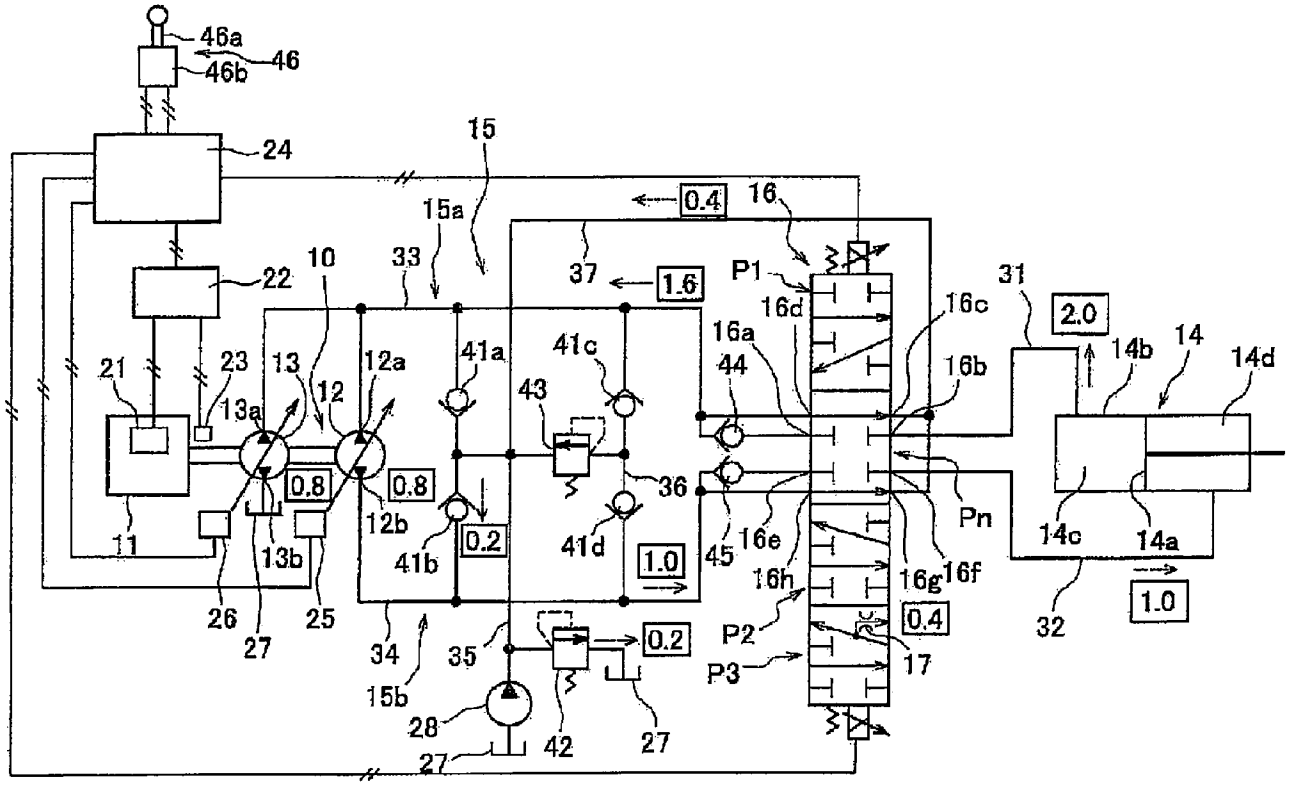
FIG. 2 is a block diagram of a configuration of the hydraulic drive system according to the first exemplary embodiment.

FIG. 2 is a block diagram illustrating a configuration of a hydraulic drive system. The hydraulic drive system is a system for driving the boom 90. The hydraulic drive system has an engine 11, a main pump 10, the hydraulic cylinder 14, a hydraulic fluid flowpath 15, a control valve 16, and a pump controller 24.

The engine 11 drives the main pump 10. The engine 11 is an example of a driving source in the present invention. The engine 11 is a diesel engine, for example, and the output of the engine 11 is controlled by adjusting an injection amount of fuel from a fuel injection device 21. The adjustment of the fuel injection amount is performed by an engine controller 22 controlling the fuel injection device 21. An actual rotation speed of the engine 11 is detected by a rotation speed sensor 23, and detection signals are input into the engine controller 22 and the pump controller 24.

The main pump 10 includes a first hydraulic pump 12 and a second hydraulic pump 13. The first hydraulic pump 12 and the second hydraulic pump 13 are driven by the engine 11 to discharge hydraulic fluid. The hydraulic fluid discharged from the main pump 10 is supplied to the hydraulic cylinder 14 via the control valve 16.

The first hydraulic pump 12 is a variable displacement hydraulic pump. The displacement of the first hydraulic pump 12 is controlled by controlling a tilt angle of the first hydraulic pump 12. The tilt angle of the first hydraulic pump 12 is controlled by a first pump-flow-amount control unit 25. The first pump-flow-amount control unit 25 controls the flow amount discharged from the first hydraulic pump 12 by controlling the tilt angle of the first hydraulic pump 12 on the basis of command signals from the pump controller 24.

The first hydraulic pump 12 is a two-directional discharge hydraulic pump. Specifically, the first hydraulic pump 12 has a first pump port 12*a* and a second pump port 12*b*. The first hydraulic pump 12 is switchable between a first discharge state and a second discharge state. The first hydraulic pump 12 inducts hydraulic fluid from the second pump port 12*b* and discharges hydraulic fluid from the first pump port 12*a* in the first discharge state. The first hydraulic pump 12 inducts hydraulic fluid from the first pump port 12*a* and discharges hydraulic fluid from the second pump port 12*b* in the second discharge state.

The second hydraulic pump 13 is a variable displacement hydraulic pump. The displacement of the second hydraulic pump 13 is controlled by controlling the tilt angle of the second hydraulic pump 13. The tilt angle of the second hydraulic pump 13 is controlled by a second pump-flow-amount control unit 26. The second pump-flow-amount control unit 26 controls the flow amount discharged from the second hydraulic pump 13 by controlling the tilt angle of the second hydraulic pump 13 on the basis of a command signal from the pump controller 24.

The second hydraulic pump 13 is a two-directional discharge hydraulic pump. Specifically, the second hydraulic pump 13 has a first pump port 13*a* and a second pump port 13*b*. The second hydraulic pump 13 is switchable between a first discharge state and a second discharge state in the same way as the first hydraulic pump 12. The second hydraulic pump 13 inducts hydraulic fluid from the second pump port 13*b* and discharges hydraulic fluid from the first pump port 13*a* in the first discharge state. The second hydraulic pump 12 inducts hydraulic fluid from the first pump port 13*a* and discharges hydraulic fluid from the second pump port 13*b* in the second discharge state.

The hydraulic cylinder 14 is driven by hydraulic fluid discharged from the first hydraulic pump 12 and the second hydraulic pump 13. As described above, the hydraulic cylinder 14 drives the boom 90. The distal end of the boom 90 is raised due to the expansion of the hydraulic cylinder 14. That is, the work implement 2 is raised. The distal end of the boom 90 is lowered due to the contraction of the hydraulic cylinder 14. That is, the work implement 2 is lowered. The work implement 2 may also be lowered due to the expansion of the hydraulic cylinder 14 according to the attachment state of the hydraulic cylinder 14. In this case, the work implement 2 is raised due to the contraction of the hydraulic cylinder 14. The hydraulic cylinder 14 includes a cylinder rod 14*a* and a cylinder tube 14*b*. The inside of the cylinder tube 14*b* is partitioned by the cylinder rod 14*a* into a first chamber 14*c* and a second chamber 14*d*.

The hydraulic cylinder 14 expands and contracts by switching between the supply and exhaust of hydraulic fluid to and from the first chamber 14*c* and the second chamber 14*d*. Specifically, the hydraulic cylinder 14 expands due to the supply of hydraulic fluid into the first chamber 14*c* and the exhaust of hydraulic fluid from the second chamber 14*d*. The hydraulic cylinder 14 contracts due to the supply of hydraulic fluid into the second chamber 14*d* and the exhaust of hydraulic fluid from the first chamber 14*c*. A pressure receiving area of the cylinder rod 14*a* in the first chamber 14*c* is greater than a pressure receiving area of the cylinder rod 14*a* in the second chamber 14*d*. Therefore, when the hydraulic cylinder 14 is expanded, more hydraulic fluid is supplied to the first chamber 14*c* than is exhausted from the second chamber 14*d*. When the hydraulic cylinder 14 is contracted, more hydraulic fluid is exhausted from the first chamber 14*c* than is supplied to the second chamber 14*d*.

The hydraulic fluid flowpath 15 is connected to the first hydraulic pump 12, the second hydraulic pump 13, and the hydraulic cylinder 14. Specifically, the hydraulic fluid flowpath 15 includes a first flowpath 15*a* and a second flowpath 15*b*. The first flowpath 15*a* connects the first pump port 12*a* of the first hydraulic pump 12 and the first chamber 14*c* of the hydraulic cylinder 14. The first pump port 13*a* of the second hydraulic pump 13 is connected to the first flowpath 15*a*. The second flowpath 15*b* connects the second pump port 12*b* of the first hydraulic pump 12 and the second chamber 14*d* of the hydraulic cylinder 14. The second pump port 13*b* of the second hydraulic pump 13 is connected to a hydraulic fluid tank 27.

The first flowpath 15*a* has a first cylinder flowpath 31 and a first pump flowpath 33. The second flowpath 15*b* has a second cylinder flowpath 32 and a second pump flowpath 34. The first cylinder flowpath 31 is connected to the first chamber 14*c* of the hydraulic cylinder 14. The second cylinder path 32 is connected to the second chamber 14*d* of the hydraulic cylinder 14. The first pump flowpath 33 is a path for supplying hydraulic fluid to the first chamber 14*c* of the hydraulic cylinder 14 via the first cylinder flowpath 31, or for recovering hydraulic fluid from the first chamber 14*c* of the hydraulic cylinder 14 via the first cylinder flowpath 31.

The first pump flowpath 33 is connected to the first pump port 12*a* of the first hydraulic pump 12. The first pump flowpath 33 is connected to the first pump port 13*a* of the second hydraulic pump 13. Therefore, hydraulic fluid is supplied to the first pump flowpath 33 from both the first hydraulic pump 12 and the second hydraulic pump 13. The second pump flowpath 34 is a path for supplying hydraulic fluid to the second chamber 14*d* of the hydraulic cylinder 14 via the second cylinder path 32, or for recovering hydraulic fluid from the second chamber 14*d* of the hydraulic cylinder 14 via the second cylinder path 32.

The second pump flowpath 34 is connected to the second pump port 12*b* of the first hydraulic pump 12. The second pump port 13*b* of the second hydraulic pump 13 is connected to a hydraulic fluid tank 27. Therefore, hydraulic fluid from the first hydraulic pump 12 is supplied to the second pump flowpath 34. As described above, the hydraulic fluid flowpath 15 configures a closed circuit between the main pump 10 and the hydraulic cylinder 14 with the first flowpath 15*a* and the second flowpath 15*b*.

The hydraulic drive system further includes a charge pump 28. The charge pump 28 is a hydraulic pump for replenishing hydraulic fluid to the first flowpath 15*a* or the second flowpath 15*b*. The charge pump 28 is driven by the engine 11 to discharge hydraulic fluid. The charge pump 28 is a fixed displacement hydraulic pump. The hydraulic fluid flowpath 15 further includes a charge circuit 35. The charge circuit 35 is connected to the first pump flowpath 33 via a check valve 41*a*. The check valve 41*a* is open when the hydraulic pressure of the first pump flowpath 33 is lower than the hydraulic pressure of the charge circuit 35.

The charge circuit 35 is connected to the second pump flowpath 34 via a check valve 41*b*. The check valve 41*b* is open when the hydraulic pressure of the second pump flowpath 34 is lower than the hydraulic pressure of the charge circuit 35. The charge circuit 35 is connected to the hydraulic fluid tank 27 via a charge relief valve 42. The charge relief valve 42 maintains the hydraulic pressure in the charge circuit 35 at a prescribed charge pressure. When the hydraulic pressure of the first pump flowpath 33 or the second pump flowpath 34 becomes lower than the hydraulic pressure in the charge circuit 35, hydraulic fluid from the charge pump 28 is supplied to the first pump flowpath 33 or the second pump flowpath 34 via the charge circuit 35. As a result, the hydraulic pressure of the first pump flowpath 33 or the second pump flowpath 34 is maintained at a prescribed value or higher.

The hydraulic fluid flowpath 15 further includes a relief flowpath 36. The relief flowpath 36 is connected to the first pump flowpath 33 via a check valve 41*c*. The check valve 41*c* is open when the hydraulic pressure of the first pump flowpath 33 is higher than the hydraulic pressure of the relief flowpath 36. The relief flowpath 36 is connected to the second pump flowpath 34 via a check valve 41*d*. The check valve 41*d* is open when the hydraulic pressure of the second pump flowpath 34 is higher than the hydraulic pressure of the relief flowpath 36. The relief flowpath 36 is connected to the charge circuit 35 via a relief valve 43. The relief valve 43 maintains the pressure of the relief flowpath 36 at a pressure equal to or less than a prescribed relief pressure. As a result, the hydraulic pressures of the first pump flowpath 33 and the second pump flowpath 34 are maintained at a pressure equal to or less than the prescribed relief pressure.

The hydraulic drive system has a bleed-off flowpath 37. The bleed-off flowpath 37 is connected to the charge circuit 35. Excess hydraulic fluid from the first pump flowpath 33 and the second pump flowpath 34 is supplied to the bleed-off flowpath 37 when controlling the hydraulic cylinder 14 at very small speeds. A portion of the hydraulic fluid exhausted from the first chamber 14*c* when lowering the work implement 2 flows into the bleed-off flowpath 37. Control of the hydraulic cylinder 14 at very low speeds and control when lowering the work implement 2 are described in greater detail below.

The control valve 16 is an electromagnetic control valve controlled on the basis of command signals from the pump controller 24. The control valve 16 controls the flow amount of the hydraulic fluid to be supplied to the hydraulic cylinder 14 on the basis of command signals from the pump controller 24. The control valve 16 is disposed between the main pump 10 and the hydraulic cylinder 14 in the hydraulic fluid flowpath 15. When the hydraulic cylinder 14 is expanded due to the below mentioned very small speed control of the hydraulic cylinder 14, the control valve 16 controls the flow amount of the hydraulic fluid to be supplied to the hydraulic cylinder 14 from the first pump flowpath 33 and the flow amount of the hydraulic fluid to be supplied to the bleed-off flowpath 37 from the first pump flowpath 33. When the hydraulic cylinder 14 is contracted due to the very small speed control, the control valve 16 controls the flow amount of hydraulic fluid to be supplied to the hydraulic cylinder 14 from the second pump flowpath 34 and the flow amount of the hydraulic fluid to be supplied to the bleed-off flowpath 37 from the second pump flowpath 34.

The control valve 16 may be a hydraulic pressure control valve controlled by pilot hydraulic pressure. In this case, an electromagnetic proportional pressure-reducing valve is disposed between the pump controller 24 and the hydraulic pressure control valve. The electromagnetic proportional pressure-reducing valve is controlled by command signals from the pump controller 24. The electromagnetic proportional pressure-reducing valve supplies pilot hydraulic pressure to the hydraulic pressure control valve in accordance with the command signals. Switching of the hydraulic pressure control valve is controlled due to pilot hydraulic pressure. The electromagnetic proportional pressure-reducing valve reduces the pressure of the hydraulic fluid discharged from a pilot pump to generate pilot hydraulic pressure. Hydraulic fluid discharged from the charge pump 28 may also be used in place of the pilot pump.

The control valve 16 includes a first pump port 16*a*, a first cylinder port 16*b*, a first bleed-off port 16*c*, and a first bypass port 16*d*. The first pump port 16*a* is connected to the first pump flowpath 33 via a first directional control unit 44. The first directional control unit 44 is a check valve for restricting the flow of the hydraulic fluid to one direction. The first cylinder port 16*b* is connected to the first cylinder flowpath 31. The first bleed-off port 16*c* is connected to the bleed-off flowpath 37. The abovementioned first direction control unit 44 allows the flow of hydraulic fluid from the first pump flowpath 33 to the first cylinder flowpath 31 and prohibits the flow of hydraulic fluid from the first cylinder flowpath 31 to the first pump flowpath 33 when hydraulic fluid is supplied to the first cylinder flowpath 31 from the first pump flowpath 33 by the control valve 16.

The control valve 16 further includes a second pump port 16*e*, a second cylinder port 16*f*, a second bleed-off port 16*g*, and a second bypass port 16*h*. The second pump port 16*e* is connected to the second pump flowpath 34 via a second direction control unit 45. The second direction control unit 45 is a check valve for restricting the flow of hydraulic fluid to one direction. The second cylinder port 16*f* is connected to the second cylinder flowpath 32. The second bleed-off port 16*g* is connected to the bleed-off flowpath 37.

The second direction control unit 45 allows the flow of hydraulic fluid from the second pump flowpath 34 to the second cylinder flowpath 32 and prohibits the flow of hydraulic fluid from the second cylinder flowpath 32 to the second pump flowpath 34 when hydraulic fluid is supplied to the second cylinder flowpath 32 from the second pump flowpath 34 by the flow control valve 16.

The control valve 16 is able to be switched between a first position state P1, a second position state P2, a neutral position state Pn, and a third position state P3. The control valve 16 allows communication between the first pump port 16*a* and the first cylinder port 16*b* and between the second cylinder port 16*f* and the second bypass port 16*h* in the first position state P1. Therefore, the flow control valve 16 connects the first pump flowpath 33 to the first cylinder flowpath 34 via the first direction control unit 44 and connects the second cylinder flowpath 32 to the second pump flowpath 34 without passing through the second direction control unit 45 in the first position state P1. The first bypass port 16*d*, the first bleed-off port 16*c*, the second pump port 16*e*, and the second bleed-off port 16*g* are all shut off when the control valve 16 is in the first position state P1.

When the hydraulic cylinder 14 is expanded, the first hydraulic pump 12 and the second hydraulic pump 13 are driven in the first discharge state and the control valve 16 is set to the first position state P1. As a result, hydraulic fluid discharged from the first pump port 12*a* of the first hydraulic pump 12 and from the first pump port 13*a* of the second hydraulic pump 13 passes through the first pump flowpath 33, the first directional control unit 44, and the first cylinder flowpath 31 to be supplied to the first chamber 14*c* of the hydraulic cylinder 14. The hydraulic fluid in the second chamber 14*d* of the hydraulic cylinder 14 passes through the second cylinder path 32 and the second pump flowpath 34 and is recovered in the second pump port 12*b* of the first hydraulic pump 12. As a result, the hydraulic cylinder 14 expands.

The control valve 16 allows communication between the second pump port 16*e* and the second cylinder port 16*f* and between the first cylinder port 16*b* and the first bypass port 16*d* in the second position state P2. Therefore, the control valve 16 connects the first cylinder flowpath 31 to the first pump flowpath 34 without passing through the first direction control unit 44 and connects the second pump flowpath 34 to the second cylinder flowpath 32 via the second direction control unit 45 in the second position state P2. The first pump port 16*a*, the first bleed-off port 16*c*, the second bypass port 16*h*, and the second bleed-off port 16*g* are all shut off when the control valve 16 is in the second position state P2.

When the hydraulic cylinder 14 is contracted, the first hydraulic pump 12 and the second hydraulic pump 13 are driven in the second discharge state and the control valve 16 is set to the second position state P2. As a result, hydraulic fluid discharged from the second pump port 12*b* of the first hydraulic pump 12 passes through the second pump flowpath 34, the second direction control unit 45, and the second cylinder flowpath 32 to be supplied to the second chamber 14*d* of the hydraulic cylinder 14. The hydraulic fluid in the first chamber 14*c* of the hydraulic cylinder 14 passes through the first cylinder flowpath 31 and the first pump flowpath 33 to be recovered in the first pump port 12*a* of the first hydraulic pump 12 and in the first pump port 13*a* of the second hydraulic pump 13. As a result, the hydraulic cylinder 14 contracts.

The control valve 16 allows communication between the first bypass port 16*d* and the first bleed-off port 16*c* and between the second bypass port 16*h* and the second bleed-off port 16*g* in the neutral position state Pn. Therefore, the control valve 16 connects the first pump flowpath 33 to the bleed-off flowpath 37 without passing through the first directional control unit 44, and connects the second pump flowpath 34 to the bleed-off flowpath 37 without passing through the second direction control valve 45 in the neutral position state Pn. When the control valve 16 is in the neutral position state Pn, the first pump port 16*a*, the first cylinder port 16*b*, the second pump port 16*e*, and the second cylinder port 16*f* are all shut off.

The control valve 16 allows communication between the second pump port 16*e* and the second cylinder port 16*f* and between the first cylinder port 16*b* and the first bypass port 16*d* in the third position state P3. Therefore, the control valve 16 connects the first cylinder flowpath 31 to the first pump flowpath 34 without passing through the first direction control unit 44 and connects the second pump flowpath 34 to the second cylinder flowpath 32 via the second direction control unit 45 in the third position state P3. Moreover, the control valve 16 allows communication between the first bleed-off port 16*c* and the first cylinder port 16*b* via a throttle 17 in the third position state P3. Therefore, the control valve 16 connects the first cylinder flowpath 31 to the bleed-off flowpath 37 via the throttle 17 in the third position state P3.

As a result, the bleed-off flowpath 37 is connected to the first flowpath 15*a* to branch off from the first flowpath 15*a*. The first pump port 16*a*, the second bypass port 16*h*, and the second bleed-off port 16*g* are all shut off when the control valve 16 is in the third position state P3.

The control valve 16 may be set to any position state between the first position state P1 and the neutral position state Pn. As a result, the control valve 16 is able to control the flow amount of hydraulic fluid to be supplied to the first cylinder flowpath 31 from the first pump flowpath 33 via the first directional control unit 44, and the flow amount of hydraulic fluid to be supplied to the bleed-off flowpath 37 from the first pump flowpath 33. Specifically, the control valve 16 is able to control the flow amount of hydraulic fluid to be supplied from the first hydraulic pump 12 and the second hydraulic pump 13 to the first chamber 14*c* of the hydraulic cylinder 14, and the flow amount of hydraulic fluid to be supplied from the first hydraulic pump 12 and the second hydraulic pump 13 to the bleed-off flowpath 37.

The control valve 16 may be set to any position state between the second position state P2 and the neutral position state Pn. As a result, the control valve 16 is able to control the flow amount of hydraulic fluid to be supplied from the second pump flowpath 34 to the second cylinder flowpath 32 via the second direction control unit 45 and the flow amount of hydraulic fluid to be supplied from the second pump flowpath 34 to the bleed-off flowpath 37. That is, the flow control valve 16 is able to control the flow amount of hydraulic fluid to be supplied from the first hydraulic pump 12 to the second chamber 14*d* of the hydraulic cylinder 14 and the flow amount of hydraulic fluid to be supplied from the first hydraulic pump 12 to the bleed-off flowpath 37.

The control valve 16 may be set to any position state between the second position state P2 and the third position state P3. As a result, the control valve 16 is able to control the flow amount of hydraulic fluid to be bled off from the first cylinder flowpath 31 to the bleed-off flowpath 37. When the control valve 16 is in a position state between the second position state P2 and the third position state P3, an opening between the first cylinder port 16*b* and the first bypass port 16*d* is fully open. Further, an opening between the second pump port 16*e* and the second cylinder port 16*f* is fully open.

The hydraulic drive system further includes an operating device 46. The operating device 46 includes an operating member 46*a* and an operation detecting unit 46*b*. The operating member 46*a* is a member for operating the motions of the hydraulic cylinder 14. For example, the operating member 46*a* is a boom operating lever. The operating member 46*a* may be operated in two directions: a direction for expanding the hydraulic cylinder 14 from the neutral position, and a direction for contracting the hydraulic cylinder 14 from the neutral position.

The operation detecting unit 46*b* detects the operation amount (hereinbelow referred to as "boom operation amount") and the operation direction of the operating member 46*a*. The operation detecting unit 46*b* is a sensor for detecting a position of the operating member 46*a* for example. When the operating member 46 is positioned in the neutral position, the operation amount of the operating member 46*a* is zero. Detection signals that indicate the operation amount and the operation direction are input from the operation detecting unit 46*b* to the pump controller 24. The pump controller 24 calculates a target flow amount of the hydraulic fluid to be supplied to the hydraulic cylinder 14 in accordance with the operation amount of the operating member 46*a*.

The engine controller 22 controls the output of the engine 11 by controlling the fuel injection device 21. Engine output torque characteristics determined on the basis of a set target engine rotation speed and a work mode are mapped and stored in the engine controller 22. The engine output torque characteristics indicate the relationship between the output torque and the rotation speed of the engine 11. The engine controller 22 controls the output of the engine 11 on the basis of the engine output torque characteristics.

When the target flow amount is within the prescribed range set by the operating member 46*a*, the pump controller 24 uses the control valve 16 to control the flow amount of the hydraulic fluid being supplied to the hydraulic cylinder 14. When the target flow amount is greater than the prescribed range set by the operating member 46*a*, the pump controller 24 uses the first pump-flow-amount control unit 25 and the second pump-flow-amount control unit 26 to control the flow amount of the hydraulic fluid being supplied to the hydraulic cylinder 14. Specifically, when the boom operation amount is within a prescribed very small speed range, the pump controller 24 uses the control valve 16 to control the flow amount of the hydraulic fluid being supplied to the hydraulic cylinder 14. When the hydraulic cylinder 14 is expanded, the pump controller 24 uses the first pump-flow-amount control unit 25 and the second pump-flow-amount control unit 26 to control the flow amount of the hydraulic fluid being supplied to the hydraulic cylinder 14 when the operation amount of the operating member 46*a* is greater than the prescribed very small speed range. When the hydraulic cylinder 14 is contracted, the pump controller 24 uses the first pump-flow-amount control unit 25 to control the flow amount of the hydraulic fluid being supplied to the hydraulic cylinder 14 when the boom operation amount is greater than the prescribed very small speed range.

The prescribed very small speed range is an operation range of the operating member 46*a* corresponding to the prescribed range of the abovementioned target flow amount. Specifically, the "prescribed very small speed range" is an operation range of the operating member 46*a* when the hydraulic cylinder 14 is controlled at very small speeds. That is, the "prescribed very small speed range" is an operation range of the operating member 46*a* required for controlling a very small flow amount to fall below a minimum controllable flow amount of the discharge flow amount of the hydraulic pumps. For example, the prescribed very small speed range is a range of approximately 15 to 20% of the maximum operation amount in the expansion direction of the hydraulic cylinder 14 from the neutral position. The prescribed very small speed range is a range of approximately 15 to 20% of the maximum operation amount in the contraction direction of the hydraulic cylinder 14 from the neutral position. Hereinbelow, the control of the hydraulic cylinder 14 when the operation amount of the operating member 46*a* is within the prescribed operation range is referred to as "very small speed control." The control of the hydraulic cylinder 14 when the operation amount of the operating member 46*a* is greater than the prescribed operation range is referred to as "normal control." The following explanation describes the control when expanding the hydraulic cylinder 14.

The pump controller 24 controls the flow amount of hydraulic fluid to the hydraulic cylinder 14 by controlling the control valve 16 during the very small speed control of the hydraulic cylinder 14. When the boom operation amount is smaller than the prescribed very small speed range, the pump controller 24 sets the control valve 16 to the neutral position state Pn. As a result, the opening surface area between the first pump flowpath 33 and the first cylinder flowpath 31 is zero when the boom operation amount is smaller than the prescribed very small speed range. The flow control valve 16 is controlled so that as the boom operation amount increases, the opening surface area between the first pump flowpath 33 and the bleed-off flowpath 37 becomes correspondingly smaller. When the boom operation amount is zero, the pump controller 24 sets the tilt angle of the first hydraulic pump 12 and the tilt angle of the second hydraulic pump 13 to zero.

Figure 3:
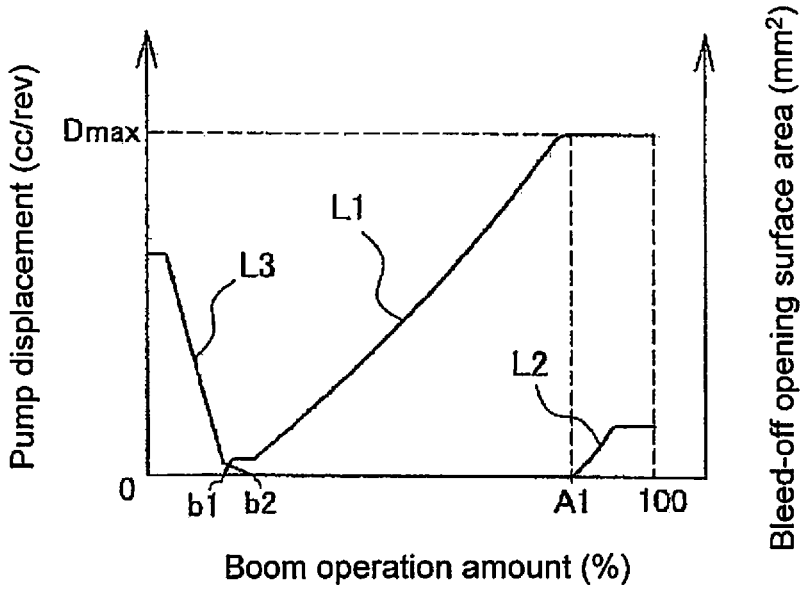
FIG. 3 illustrates pump displacement information and bleed-off opening surface area information.

The pump controller 24 controls the control valve 16 between the first position state P1 and the neutral position state Pn while the boom operation amount is within the prescribed very small speed range (see b1 to b2 in FIG. 3). Specifically, the control valve 16 is controlled so that as the boom operation amount increases, the opening surface area between the first pump flowpath 33 and the first cylinder flowpath 31 correspondingly increases when the boom operation amount is within the prescribed very small speed range. The flow control valve 16 is controlled so that as the boom operation amount increases, the opening surface area between the first pump flowpath 33 and the bleed-off flowpath 37 becomes correspondingly smaller.

The flow control valve 16 is controlled so that when the boom operation amount reaches the maximum operation amount of the very small speed range (see b2 in FIG. 3), the opening surface area between the first pump flowpath 33 and the bleed-off flowpath 37 becomes zero. Moreover, a total discharge flow amount of the first hydraulic pump 12 and the second hydraulic pump 13 is maintained at a prescribed discharge flow amount when the boom operation amount is within the prescribed very small speed range. Specifically, prescribed tilt angles of the first hydraulic pump 12 and the second hydraulic pump 13 are maintained so that the total discharge flow amount of the first hydraulic pump 12 and the second hydraulic pump 13 is maintained at the prescribed discharge flow amount. The prescribed discharge flow amount is larger than the target flow amount that corresponds to the boom operation amount. Therefore, hydraulic fluid from the first hydraulic pump 12 and the second hydraulic pump 13 is supplied by being divided between the hydraulic cylinder 14 and the bleed-off flowpath 37. Specifically, a portion of the hydraulic fluid from the first hydraulic pump 12 and the second hydraulic pump 13 from the hydraulic fluid of the flow amount required for the very small speed control of the hydraulic cylinder 14 is supplied to the hydraulic cylinder 14 via the first cylinder flowpath 31. Moreover, excess hydraulic fluid is fed to the charge circuit 35 via the bleed-off flowpath 37. The excess hydraulic fluid is returned to the first pump flowpath 33 or the second pump flowpath 34 from the charge circuit 35 or fed to the hydraulic fluid tank 27 via the charge relief valve 42.

The pump controller 24 controls the flow amount of hydraulic fluid to the hydraulic cylinder 14 by controlling the first pump-flow-amount control unit 25 and the second pump-flow-amount control unit 26 during normal control of the hydraulic cylinder 14. Specifically, when the boom operation amount is larger than the prescribed very small speed range, the pump controller 24 sets the control valve 16 to the first position state P1. Therefore, the opening surface area between the first pump flowpath 33 and the bleed-off flowpath 37 is set to zero. That is, communication between the first pump flowpath 33 and the bleed-off flowpath 37 is closed.

When the boom operation amount is larger than the prescribed very small speed range, the pump controller 24 fully opens the opening surface area between the first pump flowpath 33 and the first cylinder flowpath 31. When the boom operation amount is larger than the prescribed very small speed range, the first pump-flow-amount control unit 25 and the second pump-flow-amount control unit 26 are controlled so that the total discharge flow amount of the first hydraulic pump 12 and the second hydraulic pump 13 becomes the target flow amount corresponding to the boom operation amount.

As a result, the full amount of hydraulic fluid to be fed from the first pump flowpath 33 to the control valve 16 is supplied to the hydraulic cylinder 14. When the hydraulic cylinder 14 is in the normal control, the pump controller 24 controls the discharge flow amount of the first hydraulic pump 12 and the discharge flow amount of the second hydraulic pump 13 so that an absorption torque of the first hydraulic pump 12 and an absorption torque of the second hydraulic pump 13 are controlled on the basis of the pump absorption torque characteristics. The pump absorption torque characteristics indicate the relationship between the pump absorption torque and the engine rotation speed. The pump absorption torque characteristics are previously set on the basis of a working mode and driving conditions and are stored in the pump controller 24.

The control of the hydraulic cylinder 14 when the hydraulic cylinder 14 is contracting includes a high-speed control in addition to the abovementioned very small speed control and the normal control. The very small speed control when the hydraulic cylinder 14 is contracting is the same as the very small speed control when the hydraulic cylinder 14 is expanding. However, when the hydraulic cylinder 14 is contracting, hydraulic fluid from the first hydraulic pump 12 is supplied to the hydraulic cylinder 14 without supplying hydraulic fluid from the second hydraulic pump 13. Therefore, a portion of the hydraulic fluid discharged from the first hydraulic pump 12 is supplied to the hydraulic cylinder 14 via the second pump flowpath 34 and the second cylinder flowpath 32.

Excess hydraulic fluid that is a portion of the hydraulic fluid discharged from the first hydraulic pump 12 is fed to the charge circuit 35 via the bleed-off flowpath 37. At this time, the pump controller 24 controls the control valve 16 to control the flow amount of hydraulic fluid supplied from the first hydraulic pump 12 to the hydraulic cylinder 14 and the flow amount of hydraulic fluid supplied from the first hydraulic pump 12 to the bleed-off flowpath 37.

The normal control when the hydraulic cylinder 14 is contracting is the same as the normal control when the hydraulic cylinder 14 is expanding. However, during normal control when the hydraulic cylinder 14 is contracting, hydraulic fluid discharged from the first hydraulic pump 12 is supplied to the hydraulic cylinder 14 via the second pump flowpath 34 and the second cylinder flowpath 32. At this time, the pump controller 24 controls the discharge flow amount of the first hydraulic pump 12 by controlling the first pump-flow-amount control unit 25.

The following is an explanation of the high-speed control. A portion of the hydraulic fluid exhausted from the first chamber 14*c* of the hydraulic cylinder 14 when the hydraulic cylinder 14 is contracting, that is when lowering the work implement 2, is fed into the bleed-off flowpath 37 in the high-speed control. Specifically, the pump controller 24 controls the control valve 16 in accordance with the boom operation amount on the basis of bleed-off opening surface area information L2 illustrated in FIG. 3. FIG. 3 illustrates pump displacement information L1 and bleed-off opening surface area information L2. The pump displacement information L1 prescribes the relationship between the boom operation amount and the displacement of the first hydraulic pump 12. The pump displacement increases in accordance with an increase in the boom operation amount as depicted by the pump displacement information L1. The displacement of the first hydraulic pump 12 reaches a maximum displacement Dmax at a prescribed value A1 of the boom operation amount.

The bleed-off opening surface area information L2 prescribes the relationship between the boom operation amount and the bleed-off opening surface area under the high-speed control. The bleed-off opening surface area is the surface area of an opening of the control valve 16 that connects the control valve 16 to the bleed-off flowpath 37. In FIG. 3, L3 represents the bleed-off opening surface area information under the abovementioned very small speed control. The bleed-off opening surface area is controlled by the control valve 16 being set to a position state between the second position state P2 and the third position state P3 in the high-speed control.

The bleed-off opening surface area is zero when the boom operation amount is less than the prescribed value A1 as depicted by the bleed-off opening surface area information L2. That is, communication between the bleed-off flowpath 37 and the first flowpath 15*a* is closed when the boom operation amount is less than the prescribed value A1. Therefore, when the boom operation amount is less than the prescribed value A1 when the work implement 2 is being lowered, all of the hydraulic fluid discharged from the first chamber 14*c* is returned to the first pump port 12*a* of the first hydraulic pump 12 and to the first pump port 13*a* of the second hydraulic pump 13 through the first flowpath 15*a*. The bleed-off opening surface area increases in accordance with an increase in the boom operation amount when the boom operation amount is equal to or greater than the prescribed value A1. Therefore, the opening that connects the control valve 16 to the bleed-off flowpath 37 begins to open when the boom operation amount reaches the prescribed value A1. That is, the opening that connects the control valve 16 to the bleed-off flowpath 37 begins to open when the displacement of the first hydraulic pump 12 reaches the maximum displacement Dmax. The bleed-off opening surface area then increases in accordance with an increase in the boom operation amount. As a result, a portion of the hydraulic fluid exhausted from the first chamber 14*c* flows into the bleed-off flowpath 37 when the boom operation amount is equal to or greater than the prescribed value A1 when lowering the work implement 2. As a result, the flow amount of hydraulic fluid returned to the first pump ports 12*a* and 13*a* is less than the full amount of hydraulic fluid exhausted from the first chamber 14*c*.

A sensor may be provided for detecting the tilt angle of the first hydraulic pump 12 based on the boom operation amount detected by the operation detecting unit 46*b*, and the pump controller 24 may determine whether the displacement of the first hydraulic pump 12 has reached the maximum displacement Dmax on the basis of the tilt angle of the first hydraulic pump 12 detected by the sensor.

An example of the flow of hydraulic fluid during high-speed control is explained with reference to FIG. 2. A ratio between the pressure receiving area in the first chamber 14*c* and the pressure receiving area in the second chamber 14*d* of the cylinder rod 14*a* is assumed to be 2:1. When lowering the work implement 2, hydraulic fluid is supplied to the second chamber 14*d* because the hydraulic cylinder 14 is contracted. When the inflow amount from the second cylinder flowpath 32 to the second chamber 14*d* is "1.0", the outflow amount from the first chamber 14*c* to the first cylinder flowpath 31 is "2.0".

The pump controller 24 sets the control valve 16 to be between the second position state P2 and the third position state P3 so that the bleed-off opening surface area reaches a value in correspondence with the boom operation amount. As a result, a hydraulic fluid portion of, for example, "0.4" that is a portion of the hydraulic fluid in the first cylinder flowpath 31 is fed to the bleed-off flowpath 37. The amount of hydraulic fluid fed to the bleed-off flowpath 37 is determined by the bleed-off opening surface area. Moreover, the remaining "1.6" portion of the hydraulic fluid is fed to the first pump flowpath 33. Because the first hydraulic pump 12 and the second hydraulic pump 13 are set to the same displacement, respective "0.8" portions of the hydraulic fluid supplied to the first pump flowpath 33 are returned to the first hydraulic pump 12 and the second hydraulic pump 13. The "0.8" portion of hydraulic fluid discharged from the first hydraulic pump 12 and a "0.2" portion of hydraulic fluid from the charge circuit 35 are supplied to the second pump flowpath 34 for a total portion of hydraulic fluid of "1.0".

The "0.2" portion of hydraulic fluid from the charge circuit 35 is a portion of the hydraulic fluid fed to the bleed-off flowpath 37. The remaining "0.2" portion of hydraulic fluid is fed from the charge circuit 35 through the charge relief valve 42 to the hydraulic fluid tank 27. The "1.0" portion of the hydraulic fluid in the second pump flowpath 34 is supplied through the control valve 16 to the second chamber 14*d* of the hydraulic cylinder 14.

The hydraulic drive system according to the present exemplary embodiment has the following features.

Figure 4:
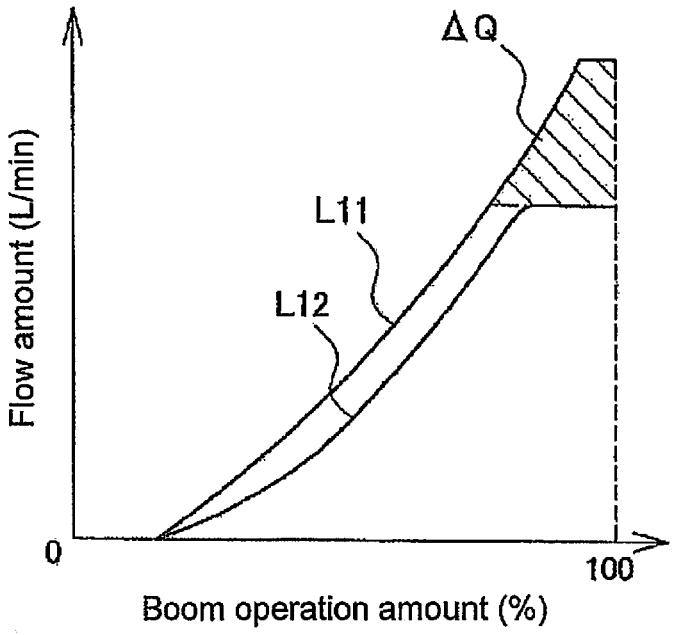
FIG. 4 illustrates the relationship between the flow amount of hydraulic fluid exhausted from a first chamber of a hydraulic cylinder and a boom operation amount when a work implement is lowered, and the relationship between the flow amount of hydraulic fluid supplied to the first chamber and the boom operation amount when the work implement is raised.

A portion of the hydraulic fluid exhausted from the first chamber 14*c* when lowering the work implement 2 flows into the bleed-off flowpath 37. FIG. 4 illustrates a relationship L11 between the flow amount of hydraulic fluid exhausted from the first chamber 14*c* and the boom operation amount when the work implement 2 is lowered, and a relationship L12 between the flow amount of hydraulic fluid supplied to the first chamber 14*c* and the boom operation amount when the work implement 2 is raised. As illustrated in FIG. 4, the flow amount of hydraulic fluid exhausted from the first chamber 14*c* when the work implement 2 is lowered is greater than the flow amount of hydraulic fluid supplied to the first chamber 14*c* when the work implement 2 is raised. As a result, the lowering speed of the work implement 2 can be made to be higher than the raising speed of the work implement 2.

Moreover, a hatched portion ΔQ in FIG. 4 is an increased portion of the outflow amount from the first chamber 14*c* required in order to make the lowering speed of the work implement 2 greater than the raising speed of the work implement 2. The hydraulic fluid corresponding to the increased portion is fed to the bleed-off flowpath 37. As a result, the lowering speed of the work implement 2 can be increased without increasing the capacities of the first hydraulic pump 12 and the second hydraulic pump 13.

The bleed-off opening surface area is determined in accordance with the boom operation amount. The intention of the operator to quickly lower the work implement 2 is reflected in the boom operation amount. Therefore, an operational feeling of the work implement 2 can be improved due to the use of the boom operation amount to control the flow of hydraulic fluid to the bleed-off flowpath 37.

The opening connected to the bleed-off flowpath 37 is opened when the boom operation amount equals or is greater than the prescribed operation amount A1 that is smaller than the maximum operation amount of the operating member 46*a*. As a result, the lowering speed of the work implement 2 can be increased while keeping the suction fluid amounts of the first hydraulic pump 12 and the second hydraulic pump 13 substantially fixed. Moreover, the prescribed operation amount A1 is the boom operation amount for which the displacement of the first hydraulic pump 12 reaches the maximum displacement Dmax. Therefore, the pump controller 24 begins to open the opening that connects the control valve 16 to the bleed-off flowpath 37 when the displacement of the first hydraulic pump 12 reaches the maximum displacement Dmax, and then increases the bleed-off opening surface area of the control valve 16 in accordance with an increase in the boom operation amount. As a result, the lowering speed of the work implement 2 can be increased even when the suction fluid amount of the first hydraulic pump 12 reaches the maximum displacement Dmax.

Second Exemplary Embodiment

Figure 5:
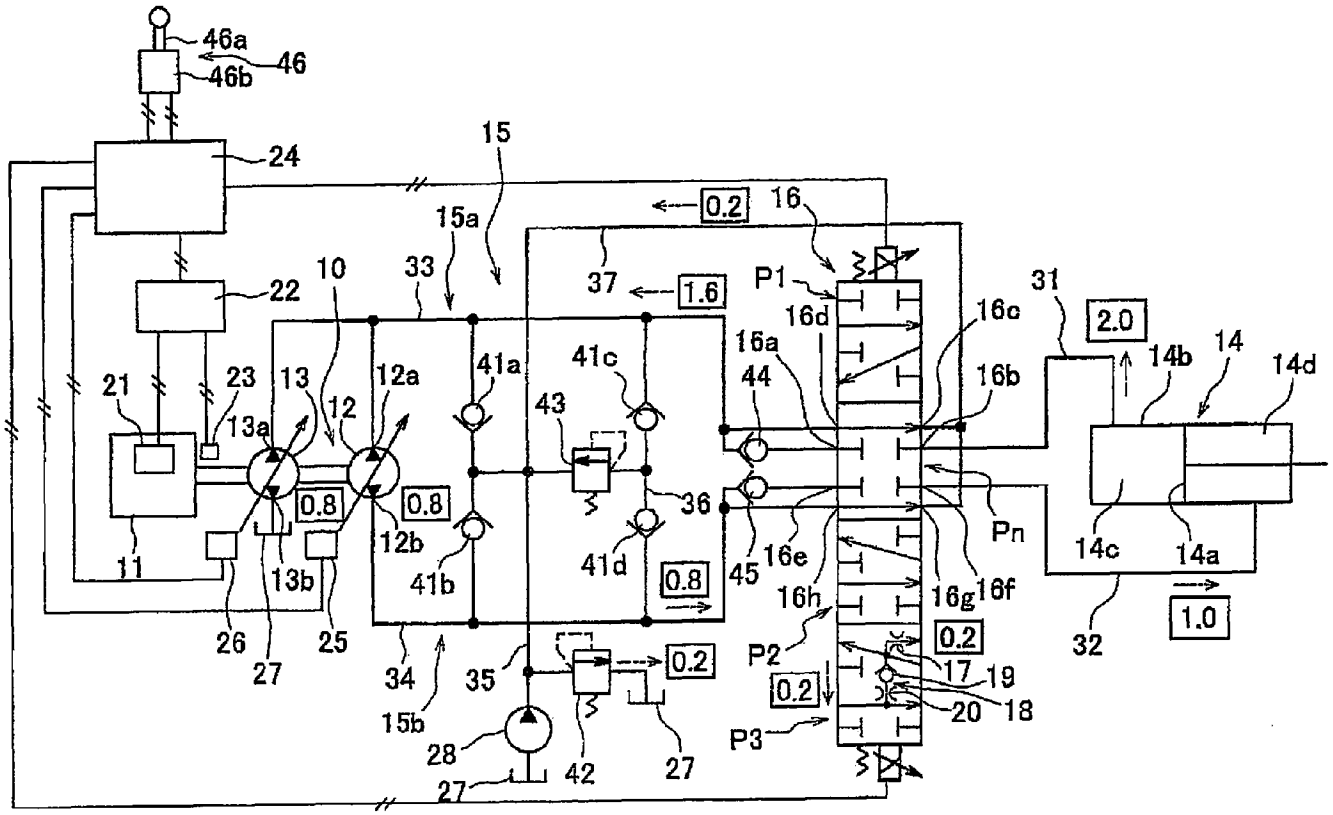
FIG. 5 is a block diagram of a configuration of the hydraulic drive system according to a second exemplary embodiment.

A hydraulic drive system according to a second exemplary embodiment of the present invention is illustrated in FIG. 5. The control valve 16 in the hydraulic drive system according to the second exemplary embodiment has a return flowpath 18 that allows communication between the first cylinder port 16*b* and the second cylinder port 16*f* in the third position state P3. When the control valve 16 is in the third position state P3, the return flowpath 18 branches off from the first flowpath 15*a* and returns a portion of the hydraulic fluid discharged from the first chamber 14*c* to the second flowpath 15*b*. A check valve 19 and a throttle 20 are disposed in the return flowpath 18. The check valve 19 allows the flow of hydraulic fluid from the first flowpath 15*a* to the second flowpath 15*b*. The check valve 19 prohibits the flow of hydraulic fluid from the second flowpath 15*b* to the first flowpath 15*a*.

The control valve 16 allows communication between the first bleed-off port 16*c* and the first cylinder port 16*b* through the throttle 17 and allows communication between the first cylinder port 16*b* and the second cylinder port 16*f* through the check valve 19 and the throttle 20 in the third position state P3. That is, the control valve 16 connects the first cylinder flowpath 31 to the bleed-off flowpath 37 via the throttle 17, and connects the first cylinder flowpath 31 to the second cylinder flowpath 32 via the check valve 19 and the throttle 20 in the third position state P3. Other configurations of the hydraulic drive system according to the second exemplary embodiment are the same as the configurations of the hydraulic drive system according to the first exemplary embodiment.

An example of the flow of hydraulic fluid during high-speed control in the hydraulic drive system according to the second exemplary embodiment is explained with reference to FIG. 5. When the inflow amount from the second cylinder flowpath 32 to the second chamber 14*d* is "1.0" when lowering the work implement 2, the outflow amount from the first chamber 14*c* to the first cylinder flowpath 31 is "2.0". The pump controller 24 sets the control valve 16 to be between the second position state P2 and the third position state P3 so that the bleed-off opening surface area reaches a value in correspondence with the boom operation amount. As a result, a hydraulic fluid portion of "0.2" that is a portion of the hydraulic fluid in the first cylinder flowpath 31 is fed to the bleed-off flowpath 37. Moreover, a hydraulic fluid portion of "0.2" that is a portion of the hydraulic fluid in the first cylinder flowpath 31 is fed to the second cylinder flowpath 32 through the return flowpath 18.

The hydraulic fluid portion of "0.2" fed to the bleed-off flowpath 37 is fed via the charge circuit 35 and the charge relief valve 42 to the hydraulic fluid tank 27. The remaining hydraulic fluid portion of "1.6" in the first cylinder flowpath 31 is fed to the first pump flowpath 33 and returned in respective hydraulic fluid portions of "0.8" to the first hydraulic pump 12 and the second hydraulic pump 13. The hydraulic fluid portion of "0.8" is discharged from the first hydraulic pump 12 to the second pump flowpath 34 and converged with the hydraulic fluid portion of "0.2" from the return flowpath 18. The total hydraulic fluid portion of "1.0" is then supplied to the second chamber 14*d* of the hydraulic cylinder 14.

As described above, the same effects as the hydraulic drive system according to the first exemplary embodiment can be achieved in the hydraulic drive system according to the second exemplary embodiment. A portion of the hydraulic fluid exhausted from the first chamber 14*c* is fed into the bleed-off flowpath 37 and another portion of the hydraulic fluid exhausted from the first chamber 14*c* flows through the return flowpath 18 and is returned to the second flowpath 15*b* when lowering the work implement 2 in the hydraulic drive system according to the second exemplary embodiment of the present invention. Accordingly, the lowering speed of the work implement can be further increased.

Third Exemplary Embodiment

Figure 6:
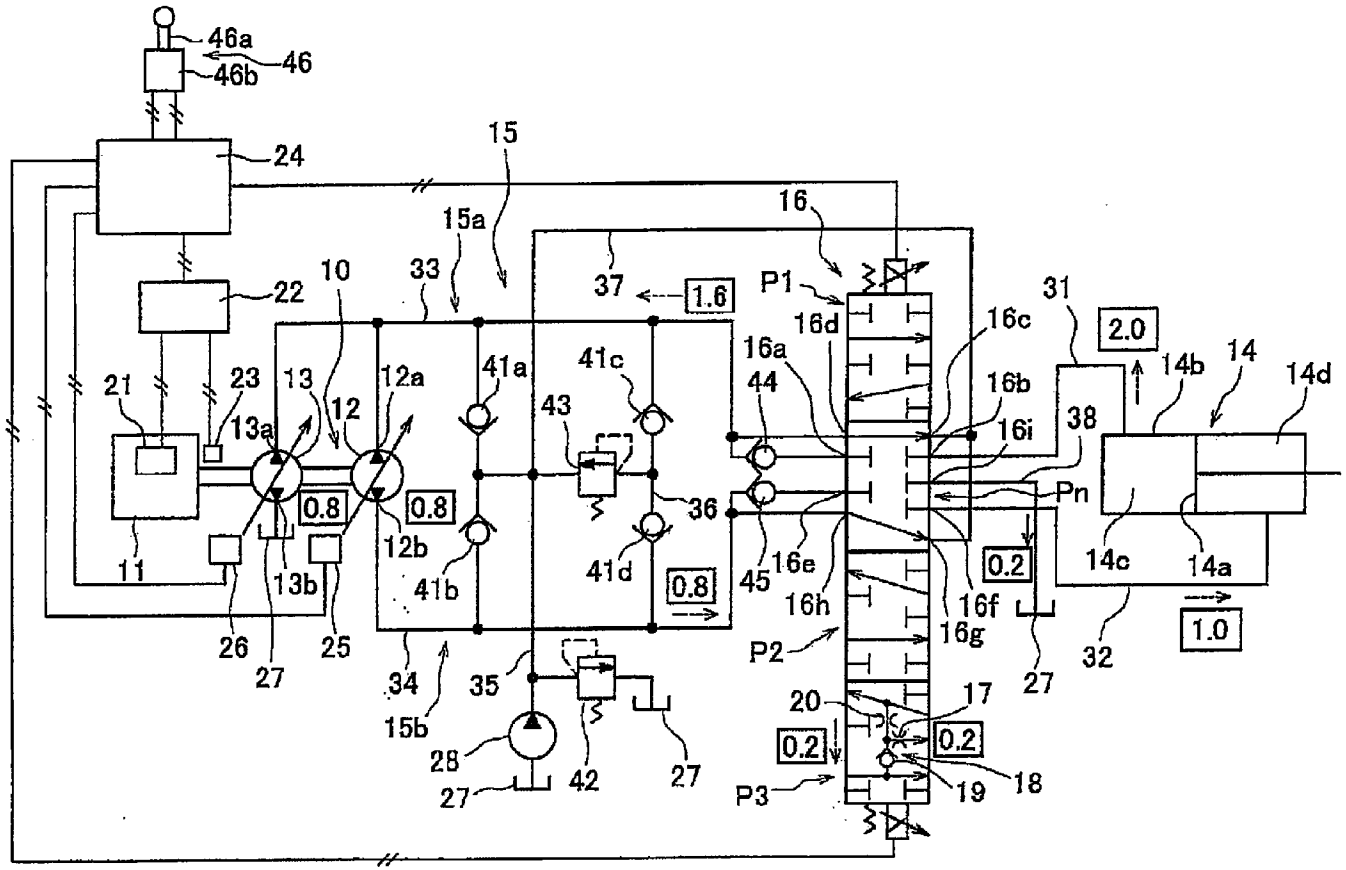
FIG. 6 is a block diagram of a configuration of the hydraulic drive system according to a third exemplary embodiment.

A hydraulic drive system according to a third exemplary embodiment of the present invention is illustrated in FIG. 6. The hydraulic drive system according to the third exemplary embodiment includes a bleed-off flowpath 38. The control valve 16 has a third bleed-off port 16*i*. The bleed-off flowpath 38 is connected to the third bleed-off port 16*i* and to the hydraulic fluid tank 27. The control valve 16 has the return flowpath 18 that allows communication between the first cylinder port 16*b* and the second cylinder port 16*f* in the third position state P3. When the control valve 16 is in the third position state P3, the return flowpath 18 is branched off from the first flowpath 15*a* and returns a portion of the hydraulic fluid discharged from the first chamber 14*c* to the second flowpath 15*b*. The check valve 19 and the throttle 20 are disposed in the return flowpath 18.

The control valve 16 allows communication between the first cylinder port 16*b* and the third bleed-off port 16*i* via the throttles 20 and 17 and allows communication between the first cylinder port 16*b* and the second cylinder port 16*f* via the throttle 20 and the check valve 19 in the third position state P3. That is, the control valve 16 connects the first cylinder flowpath 31 to the bleed-off flowpath 38 via the throttles 20 and 17, and connects the first cylinder flowpath 31 to the second cylinder flowpath 32 via the throttle 20 and the check valve 19 in the third position state P3. Other configurations of the hydraulic drive system according to the third exemplary embodiment are the same as the configurations of the hydraulic drive system according to the first exemplary embodiment.

An example of the flow of hydraulic fluid during high-speed control in the hydraulic drive system according to the third exemplary embodiment is explained with reference to FIG. 6. When the inflow amount from the second cylinder flowpath 32 to the second chamber 14*d* is "1.0" when lowering the work implement 2, the outflow amount from the first chamber 14*c* to the first cylinder flowpath 31 is "2.0". The pump controller 24 sets the control valve 16 to be between the second position state P2 and the third position state P3 so that the bleed-off opening surface area reaches a value in correspondence with the boom operation amount. As a result, a hydraulic fluid portion of "0.2" that is a portion of the hydraulic fluid in the first cylinder flowpath 31 is fed to the hydraulic fluid tank 27 through the bleed-off flowpath 38.

Moreover, a hydraulic fluid portion of "0.2" that is a portion of the hydraulic fluid in the first cylinder flowpath 31 is fed to the second cylinder flowpath 32 through the return flowpath 18. The remaining hydraulic fluid portion of "1.6" in the first cylinder flowpath 31 is fed to the first pump flowpath 33 and returned in respective hydraulic fluid portions of "0.8" to the first hydraulic pump 12 and the second hydraulic pump 13. The hydraulic fluid portion of "0.8" is discharged from the first hydraulic pump 12 to the second pump flowpath 34 and converged with the hydraulic fluid portion of "0.2" from the return flowpath 18. The total hydraulic fluid portion of "1.0" is supplied to the second chamber 14*d* of the hydraulic cylinder 14.

As described above, the same effects as the hydraulic drive system according to the first exemplary embodiment can be achieved in the hydraulic drive system according to the third exemplary embodiment. A portion of the hydraulic fluid exhausted from the first chamber 14*c* is fed into the bleed-off flowpath 38 and the other portion of the hydraulic fluid exhausted from the first chamber 14*c* flows through the return flowpath 18 and is returned to the second flowpath 15*b* when lowering the work implement 2 in the hydraulic drive system according to the third exemplary embodiment of the present invention. Accordingly, the lowering speed of the work implement can be further increased.

Fourth Exemplary Embodiment

Figure 7:
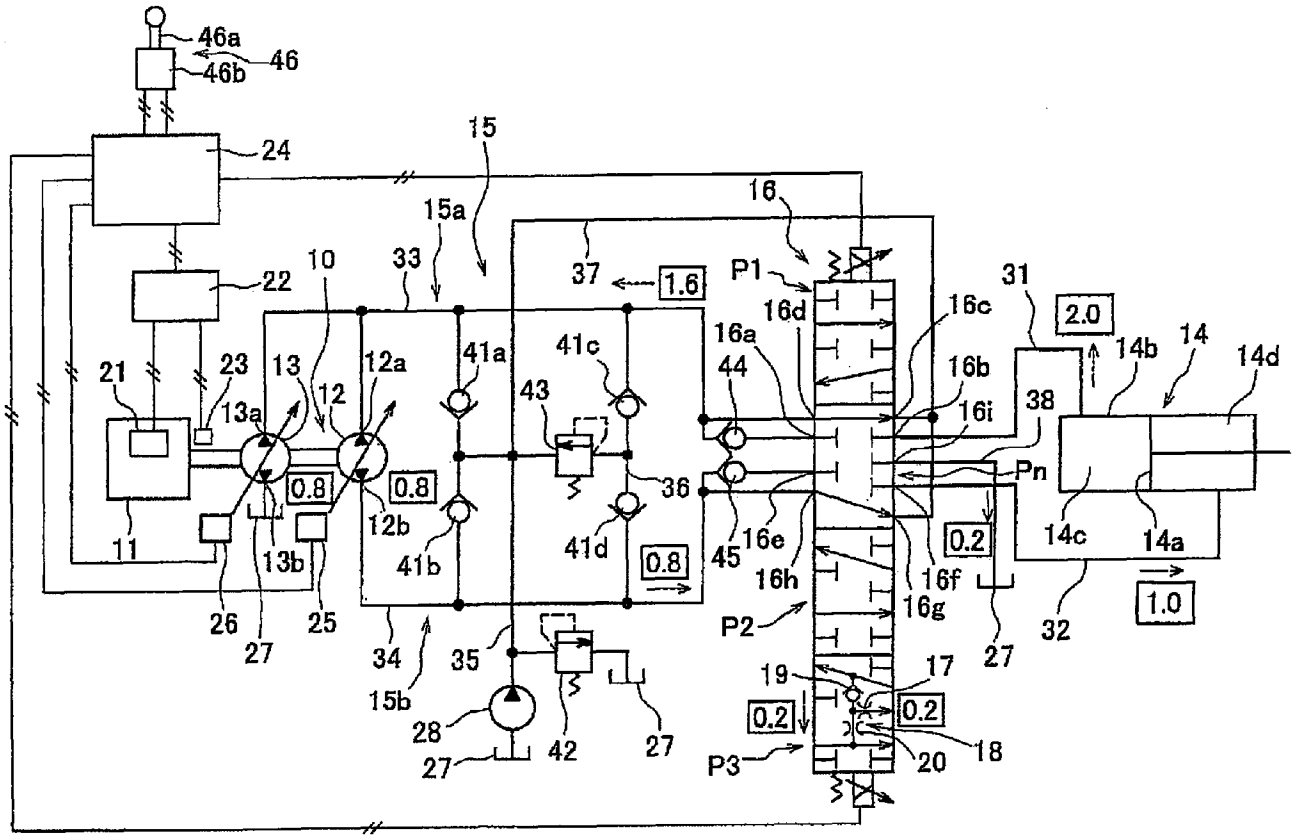
FIG. 7 is a block diagram of a configuration of the hydraulic drive system according to a fourth exemplary embodiment.

A hydraulic drive system according to a fourth exemplary embodiment of the present invention is illustrated in FIG. 7. The control valve 16 in the hydraulic drive system according to the fourth exemplary embodiment allows communication between the first cylinder port 16*b* and the third bleed-off port 16*i* via the check valve 19 and the throttle 17 and allows communication between the first cylinder port 16*b* and the second cylinder port 16*f* via the throttle 20 and the check valve 19 in the third position state P3. That is, the control valve 16 connects the first cylinder flowpath 31 to the bleed-off flowpath 38 via the check valve 19 and the throttle 17, and connects the first cylinder flowpath 31 to the second cylinder flowpath 32 via the check valve 19 and the throttle 20 in the third position state P3. Other configurations of the hydraulic drive system according to the fourth exemplary embodiment are the same as the configurations of the hydraulic drive system according to the third exemplary embodiment and an explanation thereof will be omitted. The same effects as the hydraulic drive system according to the third exemplary embodiment can be achieved in the hydraulic drive system according to the fourth exemplary embodiment.

Fifth Exemplary Embodiment

Figure 8:
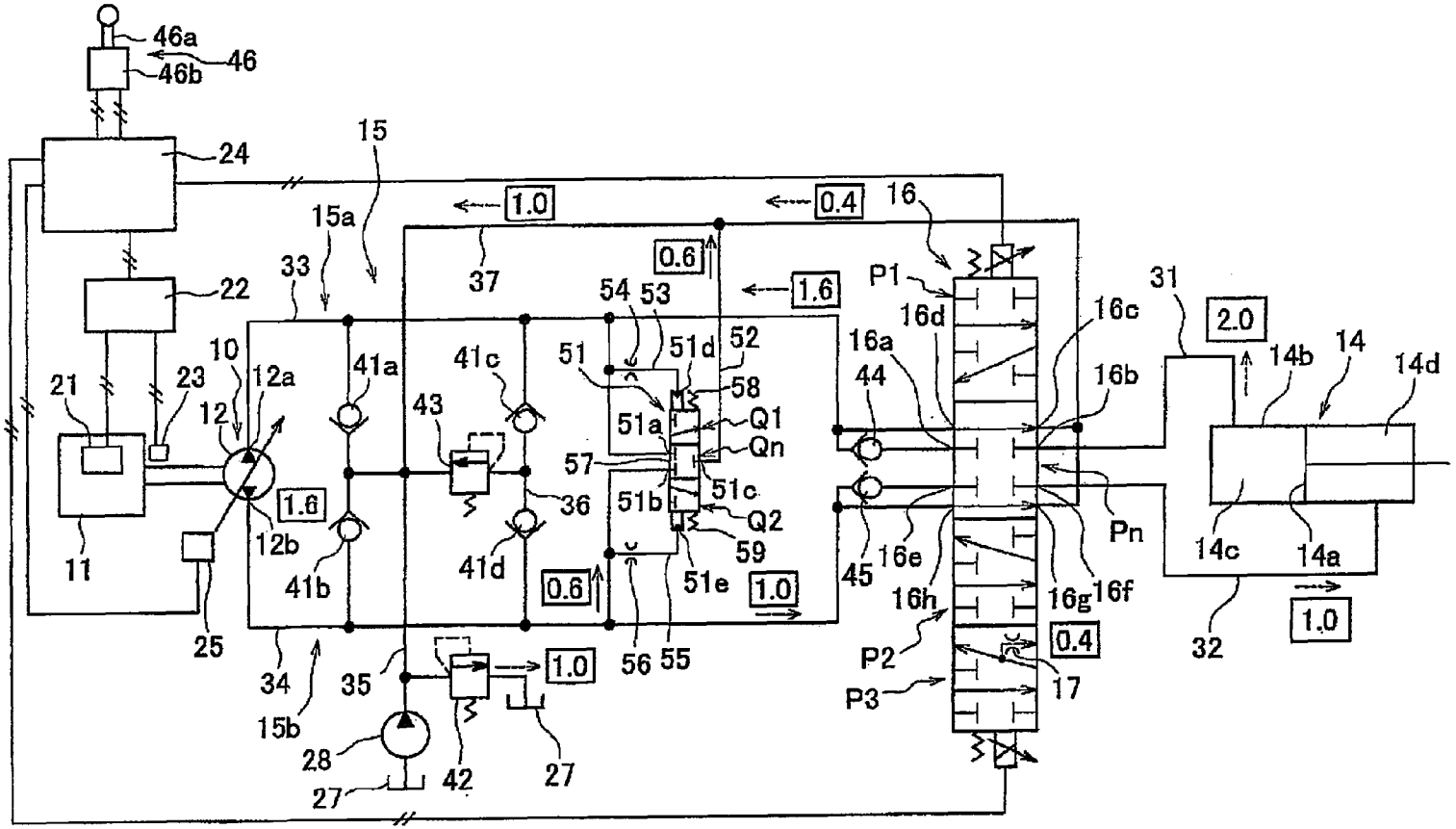
FIG. 8 is a block diagram of a configuration of the hydraulic drive system according to a fifth exemplary embodiment.

A hydraulic drive system according to a fifth exemplary embodiment of the present invention is illustrated in FIG. 8. The second hydraulic pump 13 in the hydraulic drive system of the first exemplary embodiment is omitted in the hydraulic drive system according to the fifth exemplary embodiment. Therefore, the main pump 10 is configured as one hydraulic pump (the first hydraulic pump 12). The hydraulic drive system according to the fifth exemplary embodiment includes a shuttle valve 51.

The shuttle valve 51 has a first input port 51*a*, a second input port 51*b*, a drain port 51*c*, a first pressure receiving section 51*d*, and a second pressure receiving section 51*e*. The first input port 51*a* is connected to the first flowpath 15*a*. The second input port 51*b* is connected to the second flowpath 15*b*. Specifically, the first input port 51*a* is connected to the first pump flowpath 33. The second input port 51*b* is connected to the second pump flowpath 34. The drain port 51*c* is connected to a drain flowpath 52. The drain flowpath 52 is connected to the charge circuit 35 via the bleed-off flowpath 37. The first pressure receiving section 51*d* is connected to the first flowpath 15*a* via a first pilot flowpath 53. As a result, hydraulic fluid of the first flowpath

15*a* is applied to the first pressure receiving section 51*d*. A throttle 54 is disposed in the first pilot flowpath 53. The second pressure receiving section 51*e* is connected to the second flowpath 15*b* via a second pilot flowpath 55. As a result, the fluid pressure of the second flowpath 15*b* is applied to the second pressure receiving section 51*e*. A throttle 56 is disposed in the second pilot flowpath 55.

The shuttle valve 51 is switched between a first position state Q1, a second position state Q2, and a neutral position state Qn in accordance with the fluid pressure of the first flowpath 15*a* and the fluid pressure of the second flowpath 15*b*. The shuttle valve 51 allows communication between the second input port 51*b* and the drain port 51*c* in the first position state Q1. As a result, the second flowpath 15*b* is connected to the drain flowpath 52. The shuttle valve 51 allows communication between the first input port 51*a* and the drain port 51*c* in the second position state Q2. As a result, the first flowpath 15*a* is connected to the drain flowpath 52. The shuttle valve 51 blocks communication between the first input port 51*a*, the second input port 51*b*, and the drain port 51*c* in the neutral position state Qn.

The shuttle valve 51 has a spool 57, a first elastic member 58, and a second elastic member 59. The first elastic member 58 presses the spool 57 from the first pressure receiving section 51*d* toward the second pressure receiving section 51*e*. The second elastic member 59 presses the spool 57 from the second pressure receiving section 51*e* toward the first pressure receiving section 51*d*. The first elastic member 58 is attached to the spool 57 in a state of being compressed more than its natural length. The first elastic member 58 is attached so as to press the spool 57 with a first attachment load when the spool 57 is in a neutral position. The second elastic member 59 is attached to the spool 57 in a state of being compressed more than its natural length. The second elastic member 59 is attached so as to press the spool 57 with a second attachment load when the spool 57 is in a neutral position.

The ratio between the pressure receiving area of the first pressure section 51*d* and the pressure receiving area of the second pressure section 51*e* is equal to the ratio between the pressure receiving area of the first chamber 14*c* and the pressure receiving area of the second chamber 14*d*. For example, when the ratio between the pressure receiving area of the first chamber 14*c* and the pressure receiving area of the second chamber 14*d* is 2:1, the ratio between the pressure receiving area of a first pressure section 51*d* and the pressure receiving area of a second pressure section 51*e* is 2:1.

When a force applied to the first pressure receiving section 51*d* due to the fluid pressure of the first flowpath 15*a* is greater than a force applied to the second pressure receiving section 51*e* due to the fluid pressure of the second flowpath 15*b*, the shuttle valve 51 enters the first position state Q1. Consequently, the second flowpath 15*b* is connected to the drain flowpath 52. As a result, a portion of the hydraulic fluid of the second flowpath 15*b* flows to the charge circuit 35 via the drain flowpath 52 and the bleed-off flowpath 37. When a force applied to the second pressure receiving section 51*e* due to the fluid pressure of the second flowpath 15*b* is greater than a force applied to the first pressure receiving section 51*d* due to the fluid pressure of the first flowpath 15*a*, the shuttle valve 51 enters the second position state Q2. Consequently, the first flowpath 15*a* is connected to the drain flowpath 52. As a result, a portion of the hydraulic fluid of the first flowpath 15*a* flows to the charge circuit 35 via the drain flowpath 52 and the bleed-off flowpath 37.

Other configurations of the hydraulic drive system according to the fifth exemplary embodiment are the same as the configurations of the hydraulic drive system according to the first exemplary embodiment. An example of the flow of hydraulic fluid during high-speed control in the hydraulic drive system according to the fifth exemplary embodiment is explained with reference to FIG. 8.

As described above, the ratio between the pressure receiving area of the first pressure section 51*d* and the pressure receiving area of the second pressure section 51*e* in the shuttle valve 51 is equal to the ratio between the pressure receiving area of the first chamber 14*c* and the pressure receiving area of the second chamber 14*d*. The equation $(p1+\alpha)\times S1>P2\times S2$ is derived when contracting the hydraulic cylinder 14 to lower the work implement 2 where the fluid pressure of the first chamber 14*c* is P1 and the fluid pressure of the second chamber 14*d* is P2 when an external load acting on the cylinder rod 14*a* is ignored, and the fluid pressure of the first chamber 14*c* for countering the external load acting on the cylinder rod 14*a* is $\alpha$, the pressure receiving area of the first pressure receiving section 51*d* is S1, and the pressure receiving area of the second pressure receiving section 51*e* is S2. Therefore, the shuttle valve 51 is switched to the first position state Q1 when contracting the hydraulic cylinder 14 to lower the work implement 2.

When the inflow amount from the second cylinder flowpath 32 to the second chamber 14*d* is for example "1.0" when lowering the work implement 2, the outflow amount from the first chamber 14*c* to the first cylinder flowpath 31 is "2.0". The pump controller 24 sets the control valve 16 to be between the second position state P2 and the third position state P3 so that the bleed-off opening surface area reaches a value in correspondence with the boom operation amount. As a result, a hydraulic fluid portion of "0.4" that is a portion of the hydraulic fluid in the first cylinder flowpath 31 is fed to the bleed-off flowpath 37. Moreover, the remaining "1.6" portion of the hydraulic fluid is fed to the first pump flowpath 33. Therefore, the "1.6" portion of the hydraulic fluid is returned to the first hydraulic pump 12. As a result, the "1.6" portion of the hydraulic fluid is discharged from the first hydraulic pump 12 to the second pump flowpath 34.

The "0.6" portion of the hydraulic fluid from the "1.6" portion of the hydraulic fluid in the second pump flowpath 34 is fed through the shuttle valve 51 and the drain flowpath 52 to the bleed-off flowpath 37. The "1.0" portion of the hydraulic fluid remaining in the second pump flowpath 34 is supplied through the control valve 16 to the second chamber 14*d* of the hydraulic cylinder 14. The "0.6" portion of the hydraulic fluid from the shuttle valve 51 converges with the "0.4" portion of the hydraulic fluid from the first cylinder flowpath 31 in the bleed-off flowpath 37. The total "1.0" portion of the hydraulic fluid in the bleed-off flowpath 37 is fed via the charge circuit 35 and the charge relief valve 42 to the hydraulic fluid tank 27.

As described above, the same effects as the hydraulic drive system according to the fifth exemplary embodiment can be achieved in the hydraulic drive system according to the first exemplary embodiment.

Sixth Exemplary Embodiment

Figure 9:
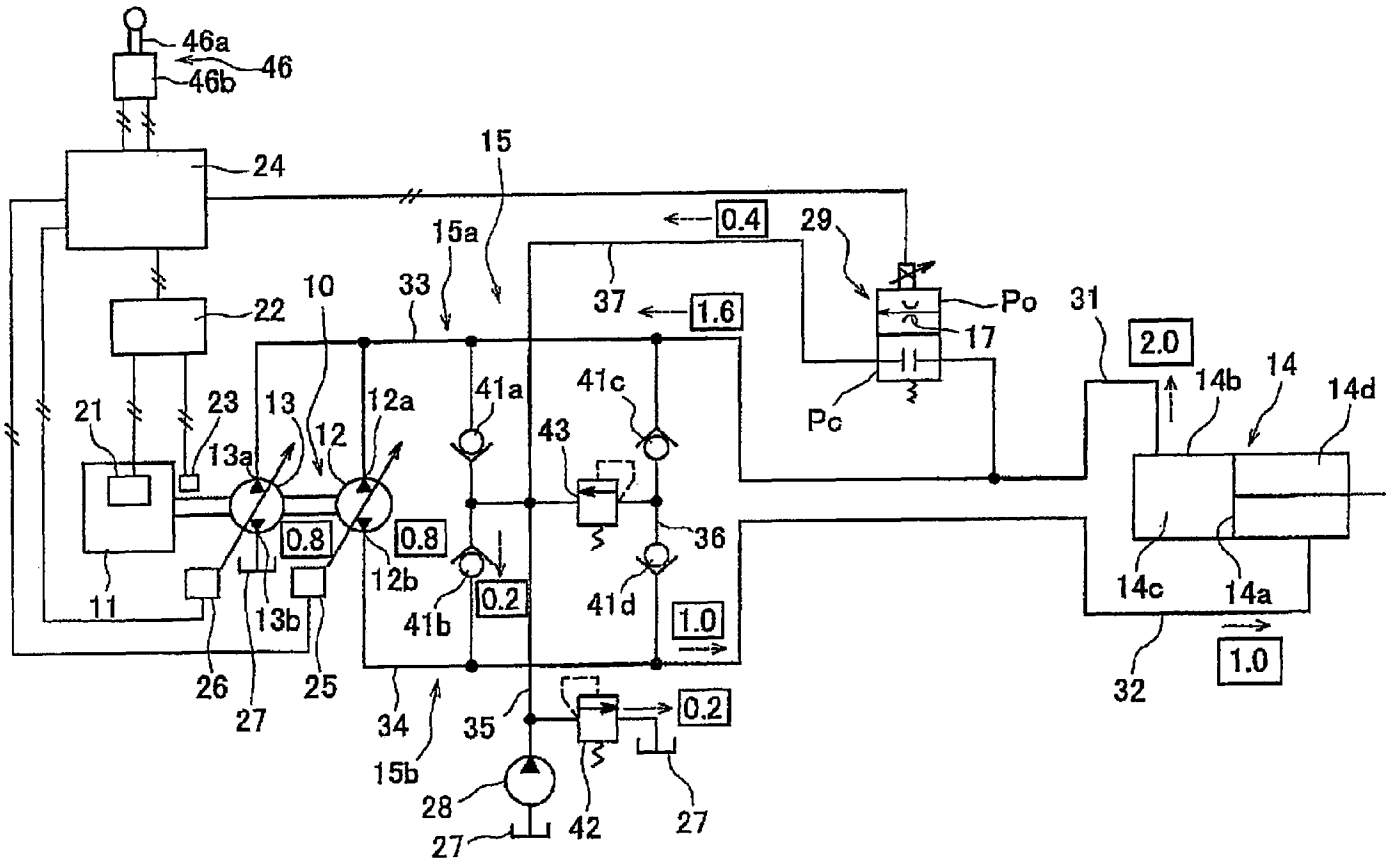
FIG. 9 is a block diagram of a configuration of the hydraulic drive system according to a sixth exemplary embodiment.

A hydraulic drive system according to a sixth exemplary embodiment of the present invention is illustrated in FIG. 9. The hydraulic drive system according to the sixth exemplary embodiment includes a control valve 29 in place of the control valve 16 of the hydraulic drive system of the first exemplary embodiment. The control valve 29 is an electromagnetic control valve controlled on the basis of command signals from the pump controller 24. The control valve 29 is disposed between the first flowpath 15*a* and the bleed-off flowpath 37. The flow control valve 29 controls the flow amount of hydraulic fluid to be supplied from the first flowpath 15*a* to the bleed-off flowpath 37 on the basis of command signals from the pump controller 24.

The control valve 29 is switchable between an open position state Po and a closed position state Pc. The control valve 29 connects the first cylinder flowpath 31 to the bleed-off flowpath 37 via the throttle 17 in the open position state Po. As a result, the bleed-off flowpath 37 is connected to the first flowpath 15*a* to branch off from the first flowpath 15*a*. The control valve 29 closes communication between the first cylinder flowpath 31 and the bleed-off flowpath 37 in the closed position state Pc. The control valve 29 may be set to any position state between the open position state Po and the closed position state Pc. As a result, the control valve 29 is controlled to change the bleed-off opening surface area in accordance with the boom operation amount in the same way as the control valve 16 of the first exemplary embodiment. Other configurations of the hydraulic drive system according to the sixth exemplary embodiment are the same as the configurations of the hydraulic drive system according to the first exemplary embodiment. An example of the flow of hydraulic fluid during high-speed control in the hydraulic drive system according to the sixth exemplary embodiment is explained with reference to FIG. 9.

When the inflow amount from the second cylinder flowpath 32 to the second chamber 14*d* is for example "1.0" when lowering the work implement 2, the outflow amount from the first chamber 14*c* to the first cylinder flowpath 31 is "2.0". The pump controller 24 sets the control valve 29 to be between the open position state Po and the closed position state Pc so that the bleed-off opening surface area of the control valve 29 reaches a value in correspondence with the boom operation amount. As a result, a hydraulic fluid portion of "0.4" that is a portion of the hydraulic fluid in the first cylinder flowpath 31 is fed to the bleed-off flowpath 37. Moreover, the remaining "1.6" portion of the hydraulic fluid is fed to the first pump flowpath 33.

Because the first hydraulic pump 12 and the second hydraulic pump 13 are set to the same displacement, respective "0.8" portions of the hydraulic fluid supplied to the first pump flowpath 33 are returned to the first hydraulic pump 12 and the second hydraulic pump 13. The "0.8" portion of hydraulic fluid discharged from the first hydraulic pump 12 and a "0.2" portion of hydraulic fluid from the charge circuit 35 are supplied to the second pump flowpath 34 for a total hydraulic fluid portion of "1.0". The "0.2" portion of hydraulic fluid from the charge circuit 35 is a portion of the hydraulic fluid fed to the bleed-off flowpath 37. The remaining "0.2" portion of hydraulic fluid is fed from the charge circuit 35 through the charge relief valve 42 to the hydraulic fluid tank 27. The "1.0" portion of the hydraulic fluid in the second pump flowpath 34 is supplied through the second cylinder flowpath 32 to the second chamber 14*d* of the hydraulic cylinder 14.

As described above, the same effects as the hydraulic drive system according to the sixth exemplary embodiment can be achieved in the hydraulic drive system according to the first exemplary embodiment.

Seventh Exemplary Embodiment

Figure 10:
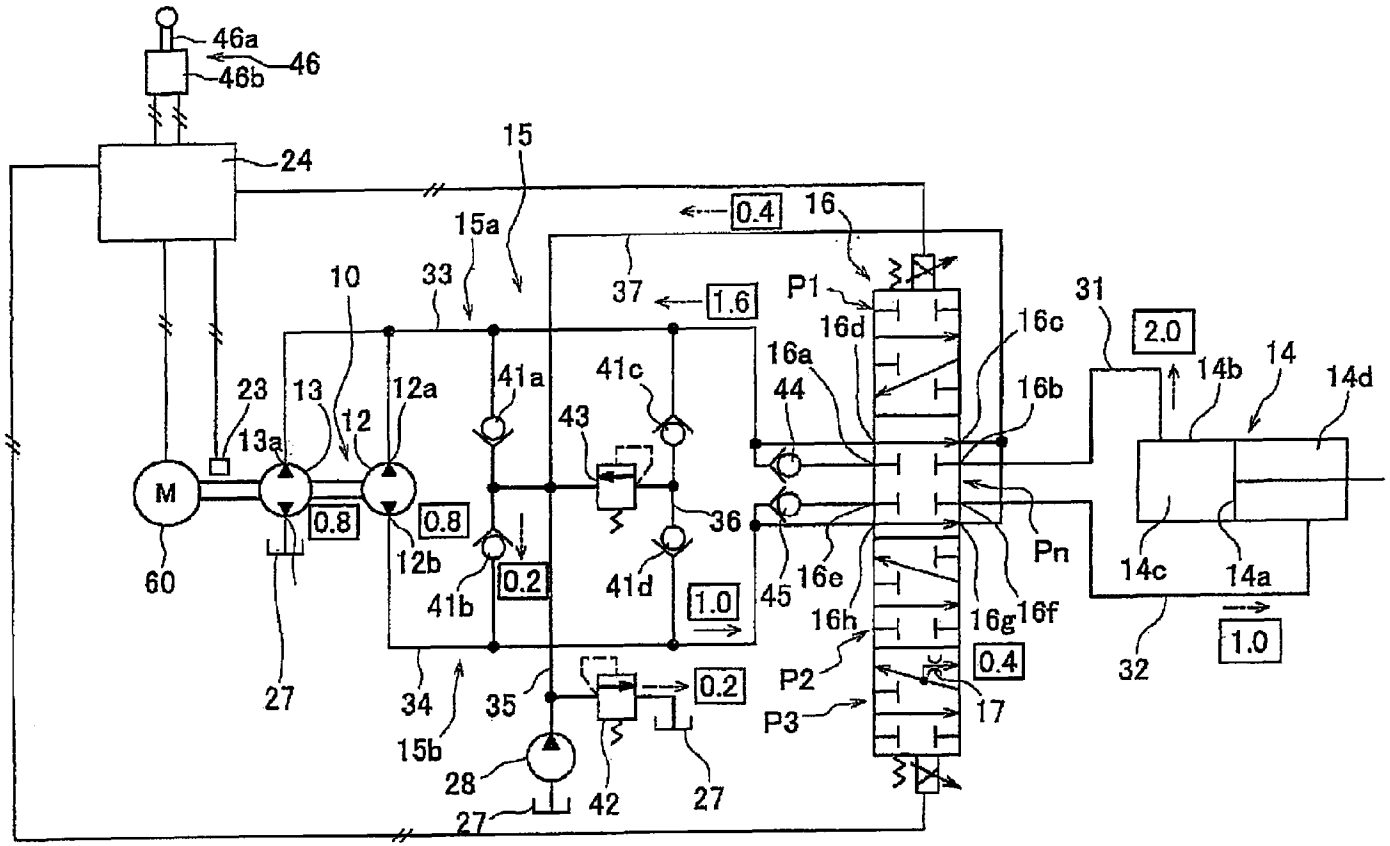
FIG. 10 is a block diagram of a configuration of the hydraulic drive system according to a seventh exemplary embodiment.

A hydraulic drive system according to a seventh exemplary embodiment of the present invention is illustrated in FIG. 10. The hydraulic drive system according to the seventh exemplary embodiment includes an electric motor 60 in place of the engine 11 of the hydraulic drive system of the first exemplary embodiment. The first hydraulic pump 12 and the second hydraulic pump 13 in the hydraulic drive system according to the seventh exemplary embodiment are fixed displacement pumps. The rotation speed sensor 23 detects an actual rotation speed of the electric motor 60. The pump controller 24 controls the discharge flow amounts from the first hydraulic pump 12 and from the second hydraulic pump 13 by controlling the rotation speed of the electric motor 60. Other configurations of the hydraulic drive system according to the seventh exemplary embodiment are the same as the configurations of the hydraulic drive system according to the first exemplary embodiment. The flow of hydraulic fluid during the high-speed control in the hydraulic drive system according to the seventh exemplary embodiment is the same as that of the hydraulic drive system according to the first exemplary embodiment. The same effects as the hydraulic drive system according to the first exemplary embodiment can be achieved in the hydraulic drive system according to the seventh exemplary embodiment.

Eighth Exemplary Embodiment

Figure 11:
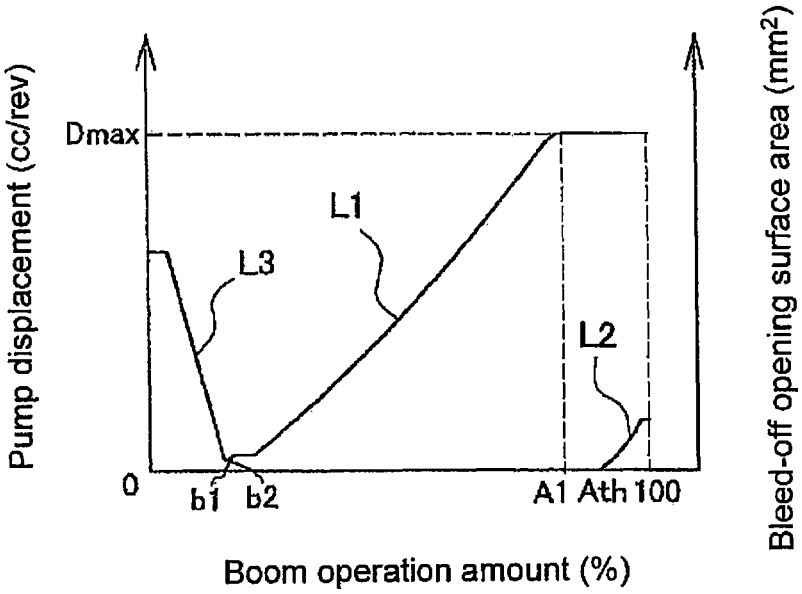
FIG. 11 illustrates pump displacement information and bleed-off opening surface area information in a hydraulic drive system according to an eighth exemplary embodiment.

The opening of the control valve 16 connected to the bleed-off flowpath 37 in the hydraulic drive system according to the first exemplary embodiment begins to open when the boom operation amount reaches the prescribed value A1. However, the opening of the control valve 16 connected to the bleed-off flowpath 37 may begin to open when the boom operation amount reaches a prescribed value Ath as illustrated in FIG. 11. The prescribed value Ath is smaller than the maximum operation amount of the operating member 46*a*. The prescribed value Ath is 85%, for example, when the maximum operation amount of the operating member 46*a* is 100%. The prescribed value Ath is larger than the prescribed value A1 of the boom operation amount that is the displacement of the first hydraulic pump 12 that reaches the maximum displacement Dmax. The lowering speed of the work implement 2 can be increased while keeping the suction fluid amounts of the first hydraulic pump 12 and the second hydraulic pump 13 approximately fixed in the hydraulic drive system according to the eighth exemplary embodiment in the same way as in the first exemplary embodiment.

Ninth Exemplary Embodiment

Figure 12:
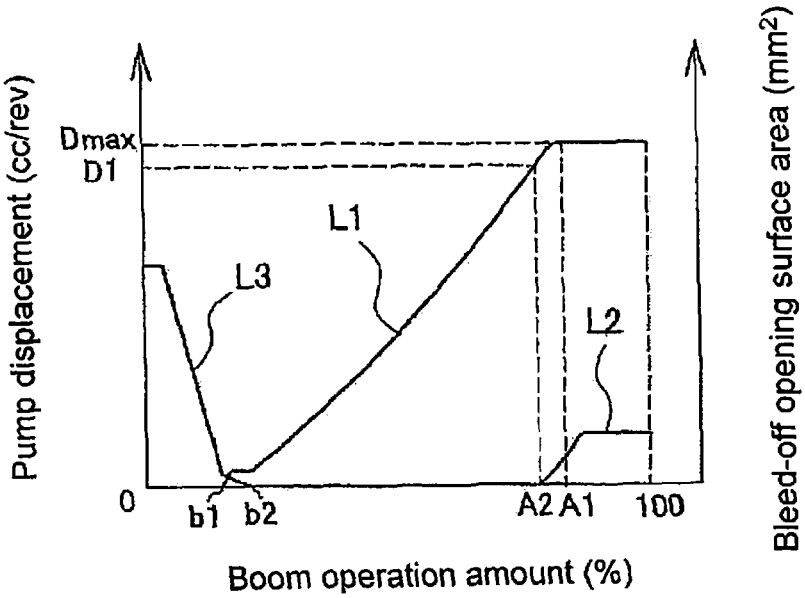
FIG. 12 illustrates pump displacement information and bleed-off opening surface area information in a hydraulic drive system according to a ninth exemplary embodiment.

The opening of the control valve 16 connected to the bleed-off flowpath 37 in the hydraulic drive system according to the first exemplary embodiment begins to open when the boom operation amount reaches the prescribed value A1. That is, the opening of the control valve 16 connected to the bleed-off flowpath 37 begins to open when the displacement of the first hydraulic pump 12 reaches the maximum displacement Dmax. However, the opening of the control valve 16 connected to the bleed-off flowpath 37 may begin to open when the displacement of the first hydraulic pump 12 reaches a prescribed displacement D1 that is smaller than the maximum displacement Dmax. A2 in FIG. 12 represents the boom operation amount when the displacement of the first hydraulic pump 12 reaches the prescribed displacement D1.

For example, the pump controller 24 determines that the displacement of the first hydraulic pump 12 reaches the prescribed displacement D1 on the basis of the tilt angle of the first hydraulic pump 12 detected by a sensor. The pump controller 24 begins to open the opening that connects the control valve 16 to the bleed-off flowpath 37 when the displacement of the first hydraulic pump 12 reaches the prescribed displacement D1, and then increases the bleed-off opening surface area of the control valve 16 in accordance with an increase in the boom operation amount. As a result, the lowering speed of the work implement 2 can be increased while keeping the suction fluid amount of the first hydraulic pump 12 approximately fixed.

Tenth Exemplary Embodiment

Figure 13:
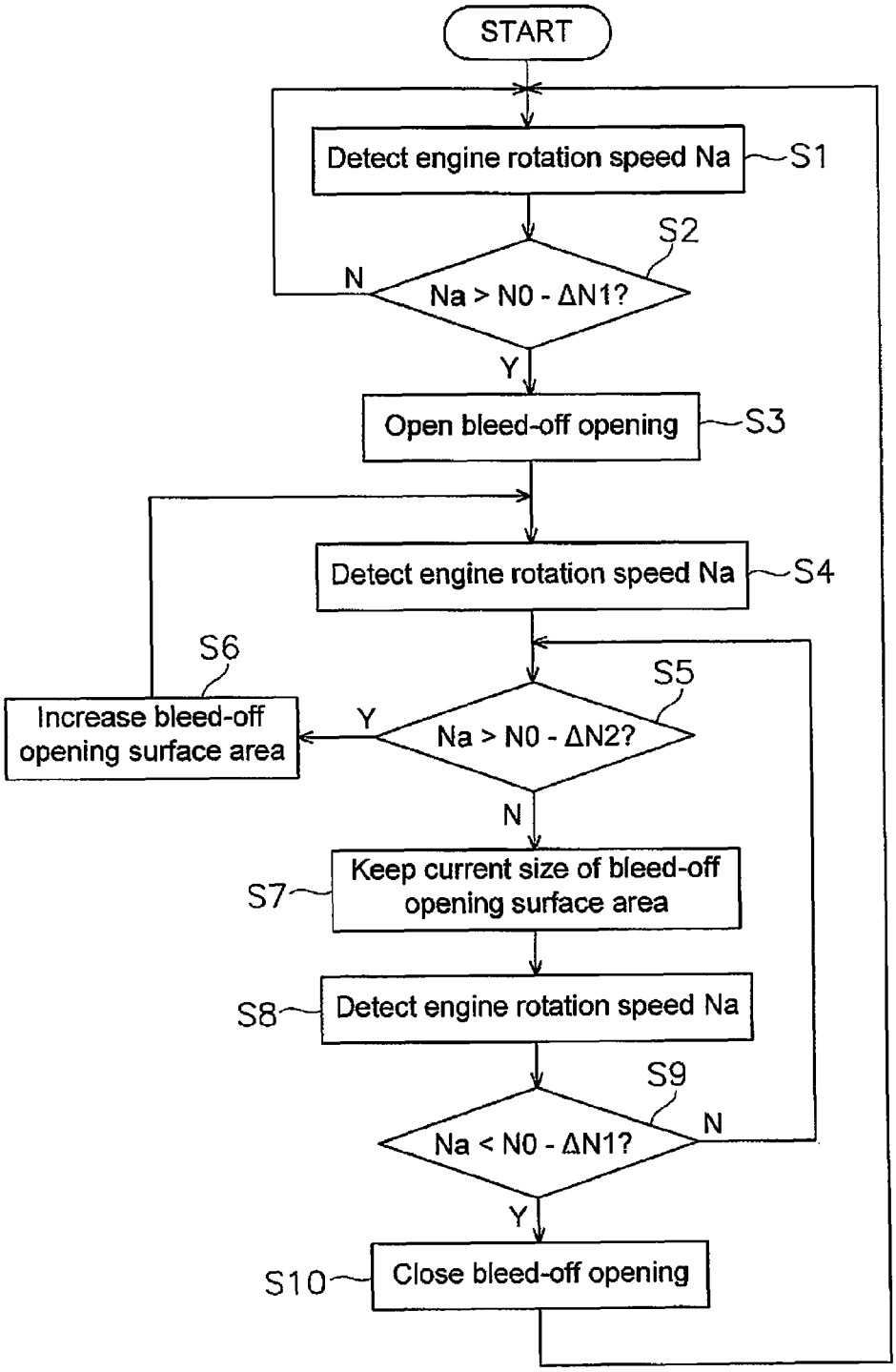
FIG. 13 is a control flow chart for a hydraulic drive system according to a tenth exemplary embodiment.

The pump controller 24 in the hydraulic drive system according to the first exemplary embodiment controls the bleed-off opening surface area of the control valve 16 in accordance with the boom operation amount. However, the bleed-off opening surface area may be controlled in accordance with the engine rotation speed. FIG. 13 is a flow chart illustrating processing for controlling the bleed-off opening surface area in the hydraulic drive system according to the tenth exemplary embodiment.

In step S1, the pump controller 24 detects an engine rotation speed Na. The pump controller 24 detects the engine rotation speed Na based on detection signals from the rotation speed sensor 23. In step S2, the pump controller 24 determines whether the current engine rotation speed Na is greater than a first threshold "N0−ΔN1". N0 is an allowable rotation speed of the engine 11. ΔN1 is a prescribed positive constant. Therefore, the first threshold "N0−ΔN1" is smaller than the allowable rotation speed N0. When the current engine rotation speed Na is equal to or less than the first threshold "N0−ΔN1", the routine returns to step S1. When the current engine rotation speed Na is greater than the first threshold "N0−ΔN1", the routine advances to step S3.

In step S3, the pump controller 24 controls the control valve 16 to open the opening (bleed-off opening) connected to the bleed-off flowpath 37. In step S4, the pump controller 24 detects the engine rotation speed Na. In step S5, the pump controller 24 determines whether the current engine rotation speed Na is greater than a second threshold "N0−ΔN2". ΔN2 is a prescribed positive constant. Therefore, the second threshold "N0−ΔN2" is smaller than the allowable rotation speed. Moreover, the second threshold "N0−ΔN2" is larger than the first threshold "N0−ΔN1". When the current engine rotation speed Na is greater than the second threshold "N0−ΔN2", the routine advances to step S6. In step S6, the pump controller 24 controls the control valve 16 to increase the bleed-off opening surface area, and the routine returns to step S4.

In step S5, when the current engine rotation speed Na is equal to or less than the second threshold "N0−ΔN2", the routine advances to step S7. In step S7, the pump controller 24 holds the current size of the bleed-off opening surface area. Next, in step S8, the pump controller 24 detects the engine rotation speed Na. In step S9, the pump controller 24 determines whether the current engine rotation speed Na is less than a first threshold "N0−ΔN1". When the current engine rotation speed Na is not less than the first threshold "N0−ΔN1", the routine returns to step S5. When the current engine rotation speed Na is less than the first threshold "N0−ΔN1", the routine advances to step S10. In step S10, the pump controller 24 controls the control valve 16 to close the opening (bleed-off opening) connected to the bleed-off flowpath 37, and then the routine returns to step S1.

When the engine rotation speed becomes greater than the first threshold "N0−ΔN1" in the hydraulic drive system according to the tenth exemplary embodiment, the opening of the control valve 16 connected to the bleed-off flowpath 37 begins to open. When the engine rotation speed is further increased and becomes greater than the second threshold "N0−ΔN2", the bleed-off opening surface area is increased. As a result, the flow amount of hydraulic fluid fed to the bleed-off flowpath 37 is increased. That is, the flow amount of hydraulic fluid to be returned to the first hydraulic pump 12 and to the second hydraulic pump 13 is reduced. As a result, an increase in the rotation speed of the first hydraulic pump 12 and the second hydraulic pump 13 can be suppressed. The lowering speed of the work implement 2 can be increased and the engine 11 can be driven at a rotation speed that is lower than the allowable rotation speed in the hydraulic drive system according to the tenth exemplary embodiment of the present invention.

Although exemplary embodiments of the present invention have been described so far, the present invention is not limited to the above embodiments and various modifications may be made within the scope of the invention.

The hydraulic drive system is not limited to a system for driving a boom on a hydraulic excavator and may be a system for driving a work implement on another work vehicle. For example, the hydraulic drive system may be a system for driving a lift arm of a wheel loader. Alternatively, the hydraulic drive system may be a system for driving a blade of a bulldozer.

The pump controller 24 in the tenth exemplary embodiment may control the bleed-off opening surface area in accordance with the rotation speed of the first hydraulic pump 12 instead of the engine rotation speed. In this case, the pump controller 24 detects the rotation speed of the first hydraulic pump 12 based on detection signals from a sensor for detecting the rotation speed of the first hydraulic pump 12. Alternatively, when an electric motor is used in place of the engine 11, the pump controller 24 may control the bleed-off opening surface area in accordance with the rotation speed of the electric motor instead of the engine rotation speed. In this case, the pump controller 24 detects the rotation speed of the electric motor based on detection signals from a sensor for detecting the rotation speed of the electric motor.

The hydraulic drive system according to the seventh exemplary embodiment includes the electric motor 60 in place of the engine 11 of the hydraulic drive system of the first exemplary embodiment. The hydraulic drive systems according to the second to sixth exemplary embodiments and the eighth to tenth exemplary embodiments may also include the electric motor 60 in place of the engine 11.

While the bleed-off flowpath 37 described in the exemplary embodiments is connected to the charge circuit 35, the bleed-off flowpath 37 may be connected to another circuit such as the hydraulic fluid tank 27. The very small speed control may be omitted in the above exemplary embodiments.

According to the exemplary embodiments of the present invention, a hydraulic drive system that allows the lowering speed of a work implement to be increased without using a large-capacity hydraulic pump can be provided.

The invention claimed is:

1. A hydraulic drive system, comprising:

a hydraulic pump having a first pump port and a second pump port, the hydraulic pump being switchable between a state of inducting hydraulic fluid from the second pump port and discharging hydraulic fluid from the first pump port, and a state of inducting hydraulic fluid from the first pump port and discharging hydraulic fluid from the second pump port;

a driving source configured to drive the hydraulic pump;

a work implement;

a hydraulic cylinder driven by hydraulic fluid discharged from the hydraulic pump, the hydraulic cylinder having a first chamber and a second chamber, the hydraulic cylinder being configured to lower the work implement by exhausting hydraulic fluid from the first chamber and supplying hydraulic fluid to the second chamber and raise the work implement by supplying hydraulic fluid to the first chamber and exhausting hydraulic fluid from the second chamber;

a hydraulic fluid flowpath having a first flowpath connecting the first pump port and the first chamber and a second flowpath connecting the second pump port and the second chamber, the hydraulic fluid flowpath configuring a closed circuit between the hydraulic pump and the hydraulic cylinder;

a bleed-off flowpath branching off from the first flowpath, the bleed-off flowpath having flowing therein a portion of hydraulic fluid exhausted from the first chamber when the work implement is lowered;

a control valve configured to control a flow amount of hydraulic fluid flowing into the bleed-off flowpath from the first flowpath; and a rotation speed sensor configured to detect a rotation speed of the hydraulic pump or the driving source; and an operating member for operating the hydraulic cylinder, wherein, a full amount of hydraulic fluid exhausted from the first chamber is returned to the first pump port through the first flowpath when an operation parameter that varies in accordance with an operation amount of the operating member is less than a prescribed value when lowering the work implement;

a portion of hydraulic fluid exhausted from the first chamber when the operation parameter is equal to or greater than the prescribed value when the work implement is lowered, flows to the bleed-off flowpath, and a flow amount of hydraulic fluid to be returned to the first pump port is less than the full amount of hydraulic fluid exhausted from the first chamber; and when the rotation speed of the hydraulic pump or the driving source exceeds a prescribed value less than a prescribed allowable rotation speed, an opening of the control valve connected to the bleed-off flowpath begins to open and an opening surface area of the opening increases in accordance with an increase in the rotation speed.

2. The hydraulic drive system according to claim 1, wherein the operation parameter is the operation amount of the operating member; and the prescribed value is a prescribed operation amount that is smaller than a maximum operation amount of the operating member.

3. The hydraulic drive system according to claim 1, wherein, the opening of the control valve connected to the bleed-off flowpath begins to open when the operation amount of the operating member is greater than or equal to the prescribed value, and an opening surface area of the opening is increased in accordance with an increase in the operation amount of the operating member.

4. The hydraulic drive system according to claim 1, wherein the hydraulic pump is a variable displacement pump;

the operation parameter is a displacement of the hydraulic pump; and the prescribed value is a maximum displacement of the hydraulic pump.

5. The hydraulic drive system according to claim 3, wherein, the opening of the control valve connected to the bleed-off flowpath begins to open when the displacement of the hydraulic pump reaches the maximum displacement, and an opening surface area of the opening is increased in accordance with an increase in the operation amount of the operating member.

6. The hydraulic drive system according to claim 1, wherein the hydraulic pump is a variable displacement pump;

the operation parameter is a displacement of the hydraulic pump; and the prescribed value is a prescribed displacement smaller than a maximum displacement of the hydraulic pump.

7. The hydraulic drive system according to claim 6, wherein, the opening of the control valve connected to the bleed-off flowpath begins to open when the displacement of the hydraulic pump reaches the prescribed displacement, and an opening surface area of the opening is increased in accordance with an increase in the operation amount of the operating member.

8. The hydraulic drive system according to claim 1, further comprising a charge circuit configured to replenish hydraulic fluid to the hydraulic fluid flowpath; wherein, the bleed-off flowpath is connected to the charge circuit.

9. The hydraulic drive system according to claim 1, further comprising a hydraulic fluid tank configured to store hydraulic fluid; wherein, the bleed-off flowpath is connected to the hydraulic fluid tank.

10. The hydraulic drive system according to claim 1, further comprising a return flowpath branching off from the first flowpath, the return flowpath being configured to return a portion of hydraulic fluid exhausted from the first chamber to the second flowpath.

11. A hydraulic drive system, comprising:

a hydraulic pump having a first pump port and a second pump port, the hydraulic pump being switchable between a state of inducting hydraulic fluid from the second pump port and discharging hydraulic fluid from the first pump port, and a state of inducting hydraulic fluid from the first pump port and discharging hydraulic fluid from the second pump port;

a driving source configured to drive the hydraulic pump;

a work implement;

a hydraulic cylinder driven by hydraulic fluid discharged from the hydraulic pump, the hydraulic cylinder having a first chamber and a second chamber, the hydraulic cylinder configured to lower the work implement by exhausting hydraulic fluid from the first chamber and supplying hydraulic fluid to the second chamber and raise the work implement by supplying hydraulic fluid to the first chamber and exhausting hydraulic fluid from the second chamber;

a hydraulic fluid flowpath having a first flowpath connecting the first pump port and the first chamber and a second flowpath connecting the second pump port and the second chamber, the hydraulic fluid flowpath configuring a closed circuit between the hydraulic pump and the hydraulic cylinder;

a bleed-off flowpath branching off from the first flowpath, the bleed-off flowpath having flowing therein a portion of hydraulic fluid exhausted from the first chamber flows when the work implement is lowered;

a control valve configured to control a flow amount of hydraulic fluid flowing into the bleed-off flowpath from the first flowpath; and a rotation speed sensor configured to detect a rotation speed of the hydraulic pump or the driving source; wherein, when the rotation speed of the hydraulic pump or the driving source exceeds a prescribed value less than a prescribed allowable rotation speed, an opening of the control valve connected to the bleed-off flowpath begins to open and an opening surface area of the opening increases in accordance with an increase in the rotation speed.

12. A hydraulic drive system, comprising:

a hydraulic pump having a first pump port and a second pump port, the hydraulic pump being switchable between a state of inducting hydraulic fluid from the second pump port and discharging hydraulic fluid from the first pump port, and a state of inducting hydraulic fluid from the first pump port and discharging hydraulic fluid from the second pump port;

a driving source configured to drive the hydraulic pump;

a work implement;

a hydraulic cylinder driven by hydraulic fluid discharged from the hydraulic pump, the hydraulic cylinder having a first chamber and a second chamber, the hydraulic cylinder configured to lower the work implement by exhausting hydraulic fluid from the first chamber and supplying hydraulic fluid to the second chamber and raise the work implement by supplying hydraulic fluid to the first chamber and exhausting hydraulic fluid from the second chamber;

a hydraulic fluid flowpath having a first flowpath connecting the first pump port and the first chamber and a second flowpath connecting the second pump port and the second chamber, the hydraulic fluid flowpath configuring a closed circuit between the hydraulic pump and the hydraulic cylinder;

a bleed-off flowpath branching off from the first flowpath, the bleed-off flowpath having flowing therein a portion of hydraulic fluid exhausted from the first chamber flows when the work implement is lowered;

a control valve configured to control a flow amount of hydraulic fluid flowing into the bleed-off flowpath from the first flowpath; and a return flowpath branching off from the first flowpath, the return flowpath configured to return a portion of hydraulic fluid exhausted from the first chamber to the second flowpath, the return flowpath including a check valve to prevent flow of the hydraulic fluid from the second flowpath to the first flowpath.

* * * * *